US008727334B2

(12) United States Patent
Nunokawa et al.

(10) Patent No.: US 8,727,334 B2
(45) Date of Patent: May 20, 2014

(54) RECORDING DEVICE WITH STANDBY TIME IN CONTROL UNIT

(71) Applicant: Seiko Epson Corporation, Tokyo (JP)

(72) Inventors: Yohei Nunokawa, Nagano (JP); Yasuhiko Yoshihisa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/948,636

(22) Filed: Jul. 23, 2013

(65) Prior Publication Data

US 2014/0021677 A1 Jan. 23, 2014

(30) Foreign Application Priority Data

Jul. 23, 2012 (JP) ..... 2012-163000

(51) Int. Cl.
*B65H 3/44* (2006.01)

(52) U.S. Cl.
CPC ..... *B65H 3/44* (2013.01)
USPC ..... 271/9.08; 271/9.03; 271/9.04; 271/9.05; 399/391

(58) Field of Classification Search
USPC ..... 271/9.03, 9.04, 9.08, 9.05, 9.11; 399/391, 393
See application file for complete search history.

(56) References Cited

U.S. PATENT DOCUMENTS

| | | | | |
|---|---|---|---|---|
| 7,398,969 | B2 * | 7/2008 | Elenes et al. | 271/9.08 |
| 7,950,648 | B2 * | 5/2011 | Asakawa et al. | 271/9.08 |
| 2005/0258586 | A1 | 11/2005 | Elenes et al. | |

FOREIGN PATENT DOCUMENTS

| | | | | |
|---|---|---|---|---|
| JP | 05286592 | A * | 11/1993 | B65H 3/44 |
| JP | 05294473 | A * | 11/1993 | B65H 1/26 |
| JP | 2005-330105 | A | 12/2005 | |

* cited by examiner

*Primary Examiner* — Gerald McClain
(74) *Attorney, Agent, or Firm* — Global IP Counselors, LLP

(57) ABSTRACT

A recording device includes a judgment unit and a control unit. The judgment unit judges whether or not a designated standby time has elapsed still without a next recording job after the current recording job performed by the recording unit has ended in a state with the first media housing unit arranged in the feed position. The control unit controls the drive unit to hold the first media housing unit in the feed position when the judgment unit judges that it is before the standby time has elapsed, and on the other hand, to move the first media housing unit from the feed position to the removal position when the judgment unit judges that it is after the standby time has elapsed.

8 Claims, 8 Drawing Sheets

RECORDING DEVICE WITH STANDBY TIME IN CONTROL UNIT

CROSS-REFERENCE TO RELATED APPLICATIONS

This application claims priority to Japanese Patent Application No. 2012-163000 filed on Jul. 23, 2012. The entire disclosure of Japanese Patent Application No. 2012-163000 is hereby incorporated herein by reference.

BACKGROUND

1. Technical Field

The present invention relates to a recording device for which a plurality of independently detachable media housing units for housing media fed for recording are provided on a device main unit.

2. Background Technology

In Patent Document 1, for example, disclosed is a system equipped with two levels of feed trays (feed cassettes), upper and lower, that are independently detachable and supply paper to this kind of recording device. The media feed direction length of the upper side first tray (first media housing unit) is shorter than that of the lower side second tray (second media housing unit), and this first tray moves automatically between the pick position (position at which feeding is possible) and the loading position (removal position). In more detail, this system is equipped with a first tray for holding a first supply source of paper, a first mechanism for sending paper from the first tray to the device by a shaft rotating in a first direction, and a second mechanism for moving the first tray from the pick position to the loading position by a shaft rotating in a second direction.

With this type of device, when the upper layer first media housing unit is at the inward position (feed position) of the device main unit, the user cannot remove the first media housing unit, or removal is difficult. However, with the system noted above, when the first tray is empty, or photographic printing has ended, the constitution is such that a driver automatically returns the first tray from the pick position to the loading position. Because of this, when the first media housing unit becomes empty, and when photographic printing has ended, the user is able to remove the first media housing unit relatively easily.

Japanese Unexamined Patent Publication No. 2005-330105 (Patent Document 1) is an example of the related art.

SUMMARY

Problems to be Solved by the Invention

With the technology noted in Patent Document 1, when photographic printing has ended, the first tray moves automatically from the pick position to the loading position. However, after the photographic printing has ended, when the next job specifying the same paper size is received relatively promptly, the first tray must promptly be returned from the loading position to the pick position, and this operation of returning the first tray to the pick position becomes a cause of delay for the next print start time, and has the problem of decreasing printing throughput.

The invention was created considering the problem noted above, and an advantage is to provide a recording device capable of reducing the frequency of delays in the start of the next recording job which uses the same first media housing unit as the feed source due to the operation of moving the first media housing unit from the feed position to the removal position after a recording job ends.

Means Used to Solve the Above-Mentioned Problems

To achieve one of the advantages noted above, the recording device is equipped with a first media housing unit capable of housing media, a second media housing unit capable of housing media, a feed unit provided in common for the first media housing unit and the second media housing unit, for feeding the media from one of that first and second media housing unit, a drive unit that moves the first media housing unit between a feed position at which feeding by the feed unit is possible, and a removal position at which removal of the first media housing unit from the device main unit is possible, a conveyance unit for conveying media fed by the feed unit, a recording unit for performing recording on conveyed media based on a recording job, a judgment unit for judging whether or not a designated standby time has elapsed still without a next recording job after the current recording job performed by the recording unit has ended in a state with the first media housing unit arranged in the feed position, and a control unit for controlling the drive unit to hold the first media housing unit in the feed position when the judgment unit judges that it is before the standby time has elapsed, and on the other hand, to move the first media housing unit from the feed position to the removal position when the judgment unit judges that it is after the standby time has elapsed.

With the constitution noted above, the judgment unit judges whether or not a designated standby time has elapsed still without a next recording job after the current recording job performed by the recording unit has ended in a state with the first media housing unit arranged in the feed position. The control unit controls the drive unit to hold the first media housing unit in the feed position when the judgment unit judges that it is before the standby time has elapsed, and on the other hand, to move the first media housing unit from the feed position to the removal position when the judgment unit judges that it is after the standby time has elapsed. Because of this, before the wait time has elapsed still without the next recording job, when the first media housing unit is held in the feed position, and meanwhile the next recording job is not received even after waiting for the wait time, the first media housing unit is moved to the removal position. Because of this, for example when a plurality of recording jobs are received almost continuously, it is possible to reduce the situation of the delay in starting the recording of the next recording job which uses the same first media housing unit as the feed source because of the wasteful operation of starting moving of the first media housing unit toward the removal position promptly after the current recording job ends despite the fact that the next recording job is received promptly after the current recording job has ended.

With the recording device noted above, it is preferable that the judgment unit also judges whether or not a next recording job for which a different media housing unit is specified than the current recording job has been received, and the control unit moves the first media housing unit to the removal position when the judgment unit judges that a next recording job for which the different media housing unit is specified has been received, even when it is before the standby time has elapsed.

With the constitution noted above, when the judgment unit judges that a next recording job for which a different media housing unit is specified than the current recording job has been received, even when it is before the standby time has elapsed, the control unit moves the first media housing unit to the removal position. Thus, it is possible to start recording relatively quickly based on the next recording job for which a different media housing unit is specified from the current recording job.

With the recording device noted above, it is preferable there is further equipped a capping unit for capping the recording unit, wherein the control unit controls the drive unit to move the first media housing unit from the feed position to the removal position before capping is done using the capping unit.

With the constitution noted above, after the recording job ends, before capping is done using the capping unit, the drive unit is driven to move the first media housing unit from the feed position to the removal position. Because of this, the user is able to remove the first media housing unit and perform media replenishment work relatively quickly with no wait time or a relatively short wait time after the recording job ends.

With the recording device noted above, it is preferable that there is further equipped a media presence detection unit for detecting the presence of at least media of the first media housing unit, wherein when the media housing unit subject to the feed operation is the first media housing unit, when an out of media state is detected for that first media housing unit, the control unit moves that first media housing unit from the feed position to the removal position, and switches the media housing unit subject to the feed operation by the feed unit to the second media housing unit.

With the constitution noted above, when the media housing unit subject to the feed operation is the first media housing unit, when an out of media state is detected for that first media housing unit, the control unit moves that first media housing unit from the feed position to the removal position, and switches the media housing unit subject to the feed operation by the feed unit to the second media housing unit. Because of this, even when the media of the first media housing unit runs out, it is possible to continue recording by feeding media from the second media housing unit.

With the recording device noted above, it is preferable that the control unit moves the first media housing unit to the removal position at least at one time among when a power on operation is received, when a power off operation is received, and when shifted to the power saving mode.

With the constitution noted above, the first media housing unit is moved to the removal position at least at one time among when a power on operation is received, when a power off operation is received, and when shifted to the power saving mode. Because of this, it is possible to obtain at least one effect among it being possible to replenish the media in the first media housing unit when the recording device is activated by a power on operation, it being possible to replenish the media in the first media housing unit even when the recording device is in a power off state, and also it being possible to replenish the media in the first media housing unit after shifting to the power saving mode.

With the recording device noted above, it is preferable that the drive unit and the conveyance unit are equipped with a common power source. With this constitution, though the drive unit and the conveyance unit are equipped with a common power source, movement of the first media housing unit to the removal position starts after the recording job ends, so it is possible to move the first media housing unit to the removal position without having an adverse effect on conveyance.

With the recording device noted above, it is preferable to be further equipped with an error detection unit for detecting out of media errors, media size errors, and media jam errors, wherein the drive unit is equipped with a power supply that is common to the first media housing unit and the conveyance unit, and the control unit moves the first media housing unit from the feed position to the removal position when at least one of the out of media error or the media size error is detected, and meanwhile, holds the first media housing unit at the feed position when the media jam error is detected.

With the constitution noted above, when at least one of the out of media error or media size error is detected, the first media housing unit is moved from the feed position to the removal position, so by performing replenishment of the media of the first media housing unit or replacement of the media, it is possible to eliminate the error at that time. Meanwhile, when a media jam error is detected, the first media housing unit is held at the feed position. Because of this, the power supply is not driven, so for example it is possible to avoid worsening of the media jam due to the conveyance unit being driven by the drive of the power supply.

With the recording device noted above, it is preferable to be further equipped with a detection unit for detecting that the first media housing unit is arranged at the removal position, wherein the feed unit is constituted so that in a state with the first media housing unit in the feed position, that first media housing unit is the subject of the feed operation, and in a state with the first media housing unit in the removal position, the second media housing unit is the subject of the feed operation, and when the second media housing unit is the subject of the feed operation, the control unit has the drive unit drive the first media housing unit in the direction facing the removal position, and when it is detected that the first media housing unit is arranged at the removal position, feeding of media from the second media housing unit starts.

With the constitution noted above, when the second media housing unit is the subject of the feed operation, the first media housing unit is driven in the direction from the feed position toward the removal position, and when it is detected that the first media housing unit is arranged at the removal position, feeding of media from the second media housing unit is started. Because of this, it is possible to avoid having the first media feed unit interfere with the feeding of media from the second media housing unit.

With the recording device noted above, it is preferable to be further equipped with a detection unit for detecting that the first media housing unit is arranged at the removal position, wherein the control unit controls the drive unit, and when moving from the feed position to the removal position, when arrangement of the first media housing unit at the removal position is not detected even when sufficient drive is implemented to have the first media housing unit reach the removal position, feeding of media from the second media housing unit starts.

With the constitution noted above, the control unit controls the drive unit, and when moving from the feed position to the removal position, when arrangement of the first media housing unit at the removal position is not detected even when sufficient drive is implemented to have the first media housing unit reach the removal position, feeding of media from the second media housing unit starts. Thus, for example even when the first media housing unit is not mounted in the device main unit, no error occurs, and it is possible to perform feeding of media from the second media housing unit.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
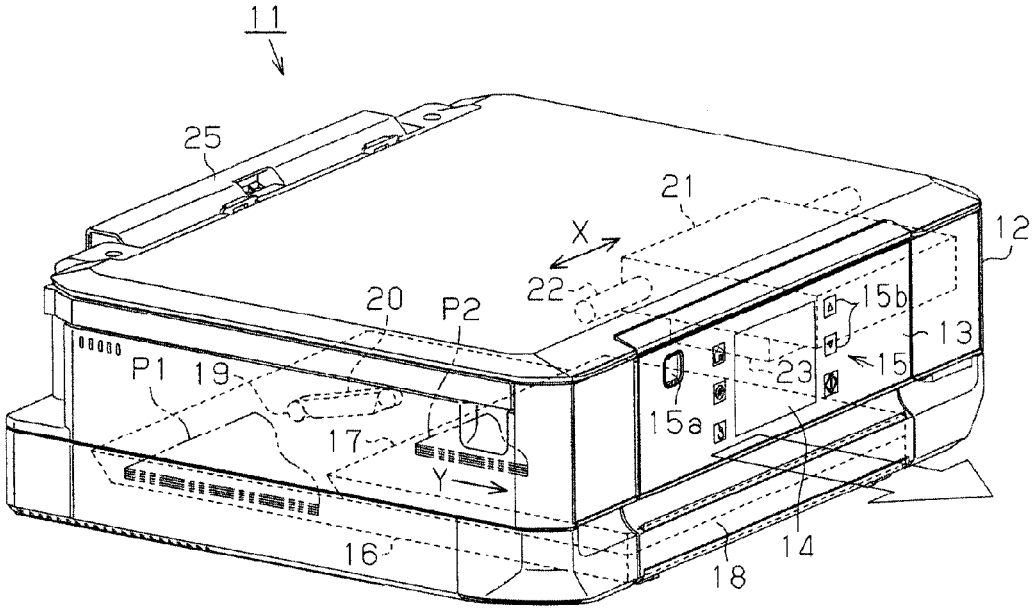
FIG. 1 is a perspective view of a printer of an embodiment.

Following, we will describe an embodiment with a specific example of a printer which is one example of a recording device based on FIG. 1 through FIG. 9. As shown in FIG. 1, the printer 11 is equipped with a device main unit 12 having a thin, roughly rectangular solid shape, and an operating panel 13 used for the user input operation provided on the front surface of the device main unit 12 (right surface in FIG. 1). The operating panel 13 is equipped with a display unit 14 including a liquid crystal panel or the like, and an operating unit 15 including a plurality of operating switches. The operating unit 15 includes a power switch 15*a* for doing on and off operations for the power supply of the printer 11, and a selection switch 15*b* for doing a selection operation of the desired selection item on a menu screen displayed on the display unit 14.

As shown in FIG. 1, at the lower side position of the operating panel 13 on the front surface of the device main unit 12, two layer feed cassettes, upper and lower, 16 and 17 capable of housing a plurality of sheets of paper P as an example of media are mounted in a state capable of being independently attached and detached (insertable and removable). The feed cassette arranged at the lower side of the two feed cassettes 16 and 17 (hereafter also called "lower cassette 16") is equipped with a cover 18 that can open and close with the bottom part as a rotation axis on its front surface side (right surface in FIG. 1), and can be pulled out for each cover 18. Also, the feed cassette arranged at the top side of the two feed cassettes 16 and 17 (hereafter also called "upper cassette 17") is mounted in a state for which in a state with the lower cassette 16 mounted, for example, it can be attached and detached in a mounting port exposed by opening the cover 18. With this embodiment, one example of the first media housing unit is constituted by the upper cassette 17, and one example of the second media housing unit is constituted by the lower cassette 16.

With this embodiment, the lower cassette 16 is able to house paper P1 of a relatively large paper size. This lower cassette 16 has a slightly shorter length than the full length (depth direction length) of the printer 11 in the conveyance direction Y, and has a slightly longer width than the maximum paper width in the width direction X. Meanwhile, the upper cassette 17 is able to house paper P2 of relatively small paper size. This upper cassette 17 has a length shorter than the full length of the lower cassette 16 in the conveyance direction Y, and has a width that is almost the same as the lower cassette 16 in the width direction X. With this example, the length of the upper cassette 17 in the conveyance direction Y is approximately ⅔ of the length of the lower cassette 16 in the conveyance direction Y. Of course, the ratio of the length in the conveyance direction Y of the lower cassette 16 and the upper cassette 17 can be set to a value as one thinks appropriate as long as upper cassette 17 is shorter.

The upper cassette 17 of this embodiment is electrically operated and able to move back and forth in the conveyance direction Y, and as shown in FIG. 1, can move between a removal position (loading position) on the side of the cover 18 that can be attached and detached by the user, and a feed position moved from this removal position to the depth direction inside the device main unit 12 (leftward in FIG. 1). Thus, if the user opens the cover 18 in a state with the upper cassette 17 arranged at the removal position, it is possible to pull out the upper cassette 17. In contrast to this, for example, in a state with the upper cassette 17 arranged at the feed position positioned in the depth direction inside the device main unit 12, the user cannot grasp the upper cassette 17, so removing the upper cassette 17 is difficult.

As shown in FIG. 1, inside the device main unit 12, at a position to the depth side of the width center part of the cassettes 16 and 17, a pickup roller 19 (also see FIG. 3) is arranged in a state supported to be rotatable on the tip part of an oscillating member 20. One of this pickup roller 19 is provided in common for the lower cassette 16 and the upper cassette 17. With this embodiment, an example of a feed unit is constituted using the pickup roller 19 and the oscillating member 20, or the like.

When the upper cassette 17 is in the removal position, the oscillating member 20 tilts so that its tip part moves downward, and the pickup roller 19 abuts the top surface of the paper P1 housed in the lower cassette 16. In this state, by the pickup roller 16 rotating, the topmost one sheet of paper P1 is fed from the lower cassette 16 to the feed direction downstream side. Also, when the upper cassette 17 is in the feed position, the oscillating member 20 is pushed up by the upper cassette 17, and the pickup roller 19 abuts the topmost one sheet of paper P2 housed inside the upper cassette 17. In this state, by the pickup roller 19 rotating, the topmost one sheet of paper P2 is fed from the upper cassette 17 to the feed direction downstream side. The paper P fed from one of the cassettes 16 and 17 is conveyed in the conveyance direction Y along a designated conveyance path while turning around at the back part inside the device main unit 12. With this specification, the paper housed in the lower cassette 16 is marked with code number "P1," and the paper housed in the upper cassette 17 is marked with code number "P2." Also, when it is not particularly necessary to distinguish between the cassette the paper is housed in, this is simply noted as "paper P."

As shown in FIG. 1, inside the device main unit 12, the carriage 21 is provided in a state that can move back and forth along the main scan direction X guided by a guide axis 22 constructed so as to extend in the main scan direction X (with this example, the width direction) intersecting the conveyance direction Y. On the bottom part of the carriage 21, a recording head 23 having a plurality of nozzles that spray ink drops on the conveyed paper P is attached. The already printed paper P is exhausted in the direction shown by the white outline arrow in FIG. 1 from an exhaust port that is exposed in a state with the cover 18 open, and for example, is placed on a stacker 24 (ejected paper tray) (see FIG. 3) that projects to the outside from the device main unit 12. At the back part of the device main unit 12, a cover 25 that opens and closes to plug the insertion hole in which the paper P can be manually inserted is provided, so it is possible to open this cover 25 and manually insert the paper P from the insertion hole.

Figure 2:
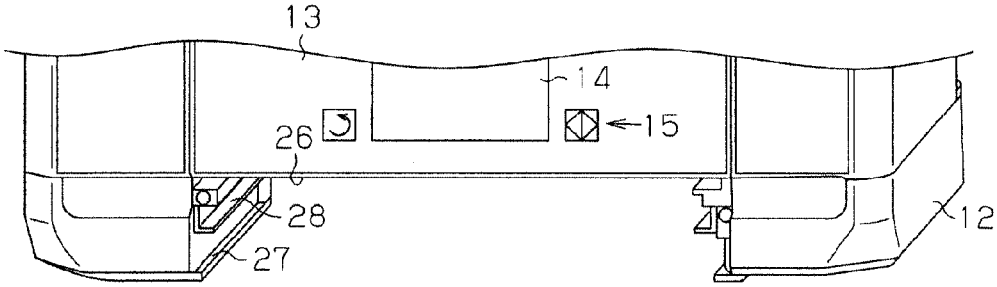
FIG. 2 is a partial perspective view of the printer showing the periphery of the housing recess in which the feed cassette is attached and detached.

As shown in FIG. 2, on the bottom side of the operating panel 13 with the device main unit 12, a cassette housing recess 26 for mounting the cassettes 16 and 17 is provided indented so as to extend along the inward direction. On the left and right inner wall part of the cassette housing recess 26 of the device main unit 12, a bottom guide rail 27 that guides the lower cassette 16 in the attaching/detaching direction as well as supports it, and a top guide rail 28 that guides the upper cassette 17 in the attaching/detaching direction as well as supports it are provided. In this way, the lower cassette 16 is able to be mounted in and removed from the cassette housing recess 26 by moving in the attaching/detaching direction guided on the bottom guide rail 27. Also, the upper cassette 17 is able to be mounted on and removed from the cassette housing recess 26 by moving in the attaching/detaching direction guided by the top guide rail 28. However, when the upper cassette 17 is mounted, it is normally arranged at the removal position without reaching the feed position. Then, the upper cassette 17 mounted in the removal position moves by electric power between the removal position and the feed position along the top guide rail 28. Later we will describe the detailed constitution of a feed mechanism including the cassettes 16 and 17, the pickup roller 19 and the like.

Figure 3:
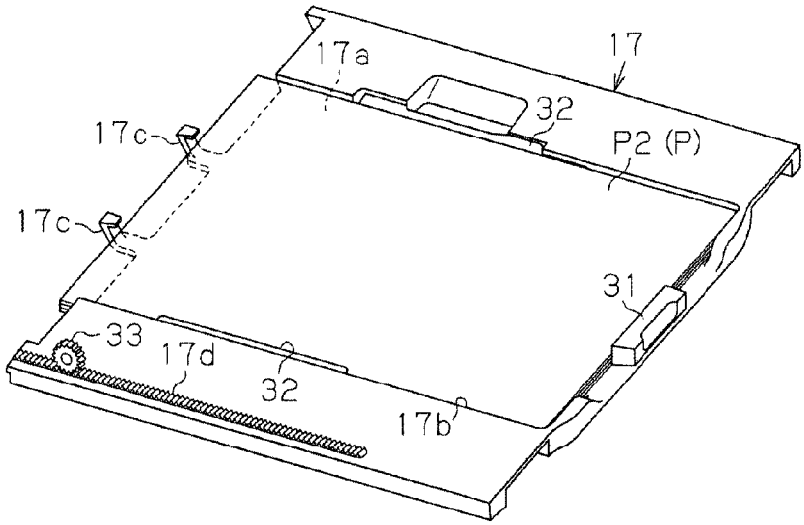
FIG. 3 is a perspective view showing the upper cassette and the lower cassette.
Figure 3:
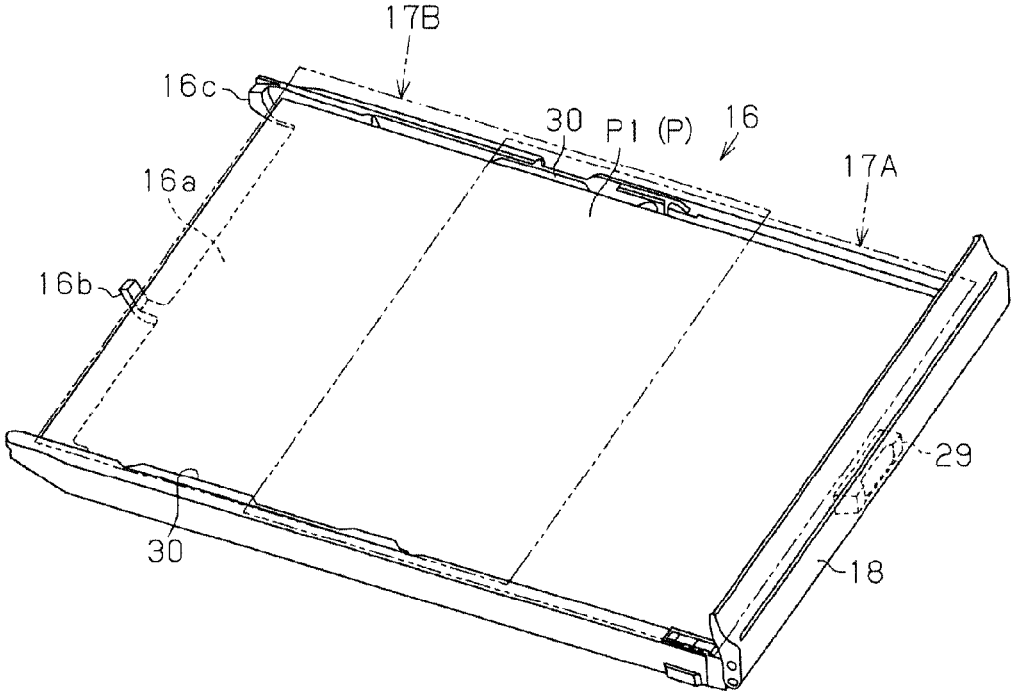

Next, we will describe the constitution of the cassettes 16 and 17. As shown in FIG. 3, the lower cassette 16 has a bottom surface 16*a* on which the paper P1 can be placed, and on the end part position of the cover 18 side of this bottom surface 16*a* is provided an edge guide 29 that can slide in the paper feed direction (reverse conveyance direction Y). The back end edge position of the paper P is restricted by this edge guide 29. Also, on the lower cassette 16, provided is a pair of edge guides 30 that can slide in the paper width direction (same as width direction X in FIG. 1) that intersects with the paper feed direction. The side edge position of the paper P1 is restricted by this pair of edge guides 30. With this embodiment, the pair of edge guides 30 are synchronized and displaced so as to be positioned symmetrically with the paper width direction center position as the center. Specifically, the printer 11 of this embodiment has the center position of the paper width direction as the feed reference position.

Also, at the mounting direction tip part of the lower cassette 16 (left edge part in FIG. 3), a stopper 16*b* that restricts the paper edge position is provided, and the constitution is such that with this stopper 16*b*, the paper P1 set in the lower cassette 16 does not fly out from the lower cassette 16. Furthermore, a pressing part 16*c* is provided on the tip part of the lower cassette 16, and with the process of mounting the lower cassette 16 in the device main unit 12, the pressing part 16*c* engages with the oscillating member 20 holding mechanism (not illustrated), and by cancelling the holding of the oscillating member 20, the pickup roller 19 drops and abuts the paper P1 inside the lower cassette 16.

Meanwhile, as shown in FIG. 3, the upper cassette 17 is equipped with a housing recess 17*b* having a bottom surface 17*a* on which paper P2 can be placed. On the edge part of the cassette mounting direction front side (right edge part in FIG. 3) with this bottom surface 17*a*, an edge guide 31 that can slide in the paper feed direction is provided. Also, a pair of edge guides 32 that can slide in the paper width direction is provided in the housing recess 17*b* of the upper cassette 17. The side edge position of the paper P2 is restricted by this pair of edge guides 32. With this embodiment, the pair of edge guides 32 are synchronized and displaced so as to be positioned symmetrically with the center position of the paper width direction as the center.

Also, at the mounting direction tip edge part (left edge part in FIG. 3) with the upper cassette 17, a stopper 17*c* that restricts the paper edge position is provided, and the constitution is such that with this stopper 17*c*, the paper P2 set in the upper cassette 17 does not fly out from the upper cassette 17. In the process of moving the upper cassette 17 from the removal position to the feed position, the stopper 17*c* engages with the oscillating member 20 and pushes the oscillating member 20 upward, and in a state with the upper cassette 17 in the feed position, the pickup roller 19 abuts the paper P2 inside the upper cassette 17.

Figure 4:
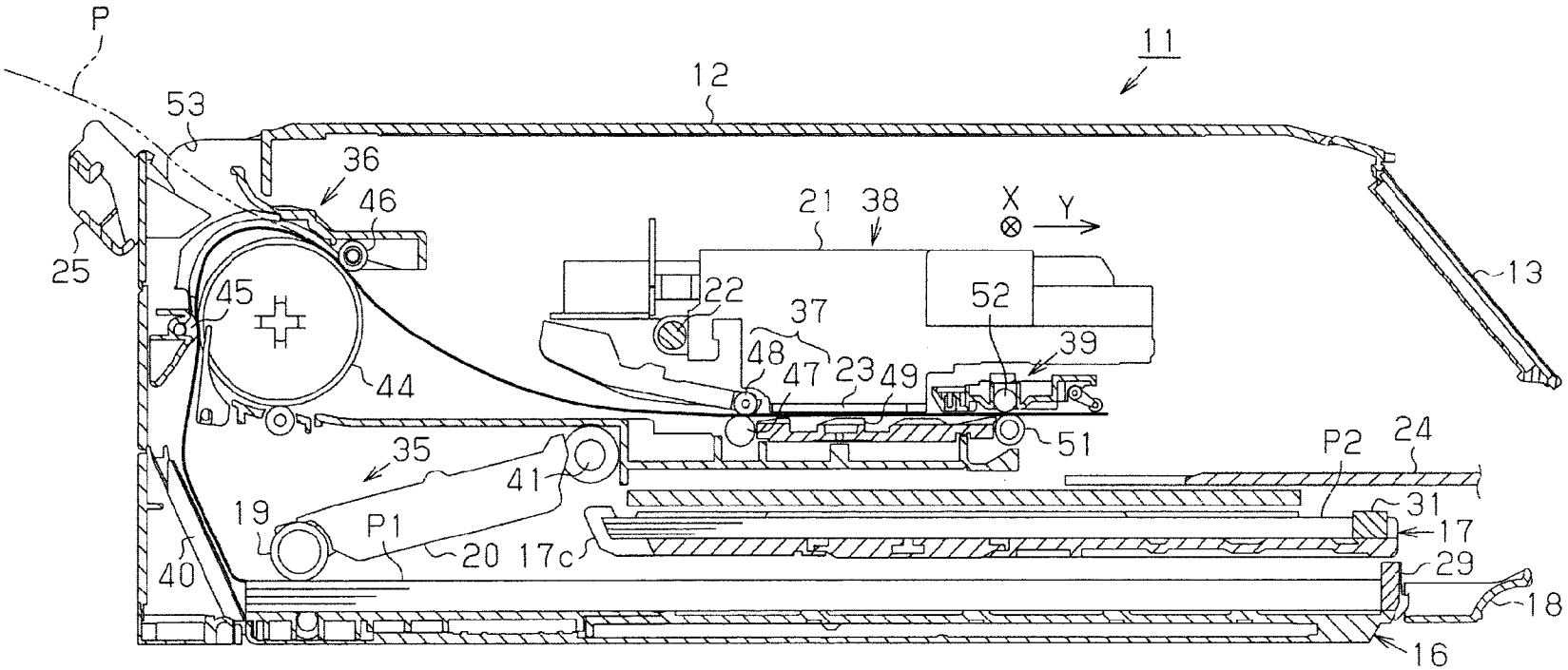
FIG. 4 is a typical side cross section view of the printer when the upper cassette is in the removal position.
Figure 5:
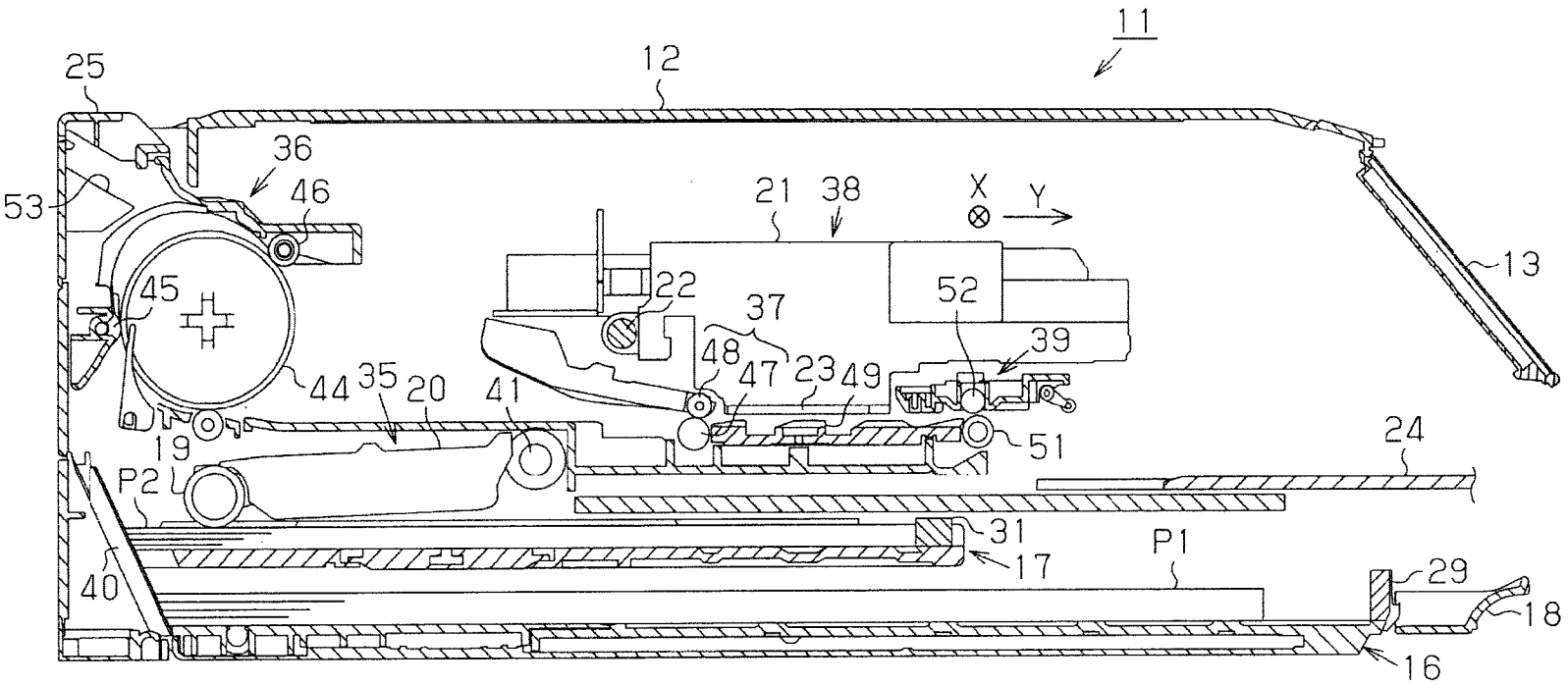
FIG. 5 is a typical side cross section view of the printer when the upper cassette is in the feed position.

Also, as shown in FIG. 3, a rack unit 17*d* of a designated length is formed along the sliding direction (paper feed direction) of the upper cassette 17 on one edge part top surface in the width direction of the upper cassette 17. A rack and pinion mechanism is constituted by a pinion gear 33 engaging with this rack unit 17*d*. The pinion gear 33 rotates by the force of an electric motor, and by the engaging position of the pinion gear 33 and the rack unit 17*d* changing by that rotation, the upper cassette 17 slides between the removal position (retraction position: FIG. 4) of the double dot-dash line shown as code 17A in FIG. 3, and similarly the feed position (end position: FIG. 5) of the double dot-dash line shown as code 17B. With this embodiment, the power source of the upper cassette 17 is in common with the power source of the conveyance system for conveying the paper P, and a conveyance motor 43 (see FIG. 6) is used.

Next, we will describe the detailed constitution of the printer 11 using FIG. 4 and FIG. 5. As shown in FIG. 4 and FIG. 5, the device main unit 12 is equipped with a cassette feed unit 35, a media feed unit 36, a media conveyance unit 37, a recording unit 38, and a forwarding unit 39. The cassette feed unit 35 is equipped with the lower cassette 16, the upper cassette 17, the pickup roller 19, and a separation unit 40 provided at a position facing the edge of the paper P housed in each cassette 16 and 17.

The lower cassette 16 and the upper cassette 17 provided above that are respectively able to house a plurality of sheets of paper P1 and P2, and can respectively be independently attached and detached with the device main unit 12. Also, even if one of the two cassettes 16 and 17 is in an unmounted state, as long as the other is mounted, it is possible to feed paper P from that mounted cassette. The upper cassette 17 slides and is displaced between the removal position (FIG. 4) and the feed position (FIG. 5) by the force of the conveyance motor 43 (see FIG. 6).

As shown in FIG. 4 and FIG. 5, the pickup roller 19 is attached in a state able to rotate on the tip part of an oscillating member 20 supported to be able to oscillate with an oscillating shaft 41 as the center on the support frame (not illustrated) inside the device main unit 12. The pickup roller 19 is rotated and driven by transmission of the force of the conveyance motor 43 via the train of gears inside the oscillating member 20. The oscillating member 20 is equipped with a holding mechanism (not illustrated) provided at a position capable of engagement with the pressing part 16*c* of the lower cassette 16 and capable of holding the pickup roller 19 at the center position, and a cam follower (not illustrated) provided at a position capable of engagement with the stopper 17*c* of the upper cassette 17.

When the lower cassette 16 is inserted into the device main unit 12 in a state with the upper and lower cassettes not mounted or in a state with the upper cassette 17 in the removal position, in the process of the cassette 16 moving to the end position (FIG. 4) in the mounting direction, the pressing part 16*c* formed on the tip end part of the lower cassette 16 engages with a holding mechanism (not illustrated), and holding of the pickup roller 19 by the holding mechanism is released. By doing this, the pickup roller 19 drops to the position at which it contacts the paper P1 housed in the lower cassette 16. Because of this, when the upper cassette 17 is at the removal position (retraction position) shown in FIG. 4, the pickup roller 19 abuts the topmost one sheet of paper P1 inside the lower cassette 16, and when the pickup roller 19 is rotated by the drive of the conveyance motor 43 in this state, the topmost paper P1 is fed from the lower cassette 16 to the feed path downstream side.

Also, from the removal position (FIG. 4) at which the upper cassette 17 is inserted in the device main unit 12, in the process of moving to the feed position (FIG. 5) which is the mounting direction end position, the stopper 17*c* (see FIG. 3 and FIG. 4) of the tip part of the upper cassette 17 engages with the cam follower (not illustrated) of the oscillating member 20, and pushes the oscillating member 20 upward. After that, when the engagement of the stopper 17*c* and the cam follower is released, the pickup roller 19 drops to the position contacting the paper P2 housed in the upper cassette 17 (FIG. 5). Because of this, as shown in FIG. 5, when the upper cassette 17 is in the feed position, the pickup roller 19 abuts the topmost item of the paper P2 housed in the upper cassette 19, and by the pickup roller 19 rotating by being driven by the conveyance motor 43 in this state, the topmost paper P2 is fed from the upper cassette 17 to the feed path downstream side. Even in a case when one of the lower cassette 16 and the upper cassette 17 is not mounted, it is possible to feed paper P from the other. Also, the topmost paper P fed from one of the cassettes 16 and 17 by the rotation of the pickup roller 19 is separated from the paper P of the second place item and thereafter by the separation unit 40 with the feed process.

As shown in FIG. 4 and FIG. 5, the media feed unit 36 provided on the feed path downstream side of the separation unit 40 is equipped with a feed drive roller 44 driven by the conveyance motor 43, a separation roller 45, and a feed driven roller 46. The separation roller 45 performs separation on the paper P again together with contact with the feed drive roller 44, and reliably sends only the topmost paper P to the feed path downstream side.

Also, the paper P sandwiched between the feed drive roller 44 and the feed driven roller 46 is conveyed to the media conveyance unit 37. The media conveyance unit 37 is similarly equipped with a conveyance drive roller 47 driven by the conveyance motor 43, and a conveyance driven roller 48 that presses and contacts the conveyance drive roller 47 and follows its rotation. The paper P is sent further to the downstream side by this media conveyance unit 37.

As shown in FIG. 4 and FIG. 5, the recording unit 38 provided on the downstream side of the conveyance direction Y of the media conveyance unit 37 is equipped with the carriage 21, the recording head 23, and a support platform 49 facing opposite the recording head 23. The recording head 23 provided in a state facing opposite the paper P at the bottom part of the carriage 21 prints an image on the paper P by spraying ink drops on the paper P in the process of the carriage 21 moving back and forth in the main scan direction X (direction orthogonal to the paper surface in FIG. 4 and FIG. 5) while being guided by the guide axis 22 by the force of the carriage motor 50 (see FIG. 5). At this time, the support platform 49 supports the paper P, and regulates the distance (gap) between the paper P and the recording head 23.

Then, the forwarding unit 39 provided at the downstream side of the support platform 49 is equipped with a first roller 51 driven by the conveyance motor 43 and a second roller 52 that contacts the first roller 51 and rotates following that. Then, the paper P for which recording was performed is fed to the downstream side of the conveyance direction Y by the forwarding unit 39, and is ejected above the stacker 24 which has slid to the front surface side of the device main unit 12. The stacker 24 is driven by the power source common to the operating panel 13, and after the movement path of the stacker 24 has opened by the operating panel 13 turning to a designated orientation angle, the stacker 24 slides to a position at which it is a designated projection volume from the device main unit 12.

Also, as shown in FIG. 4, a media feed unit for which paper can be fed manually is provided on the top part of the back side of the device main unit 12 (the left side top part in FIG. 4), and when the manual feed cover 25 is opened, it is possible to manually insert paper P from the exposed feed port 53 (shown by a double dot-dash line in FIG. 4). The manually inserted paper P is inserted between the feed drive roller 44 and the feed driven roller 46, and by the conveyance motor 43 being driven in this state, it is conveyed by the media conveyance unit 37 and the forwarding unit 39 to the downstream side of the conveyance direction Y. In other words, feeding from the cassettes 16 and 17 and feeding by hand use a common conveyance path from the nip point and thereafter of the feed drive roller 44 and the feed driven roller 46. With this embodiment, one example of the conveyance unit is constituted by the media feed unit 36, the media conveyance unit 37, and the forwarding unit 39.

Figure 6:
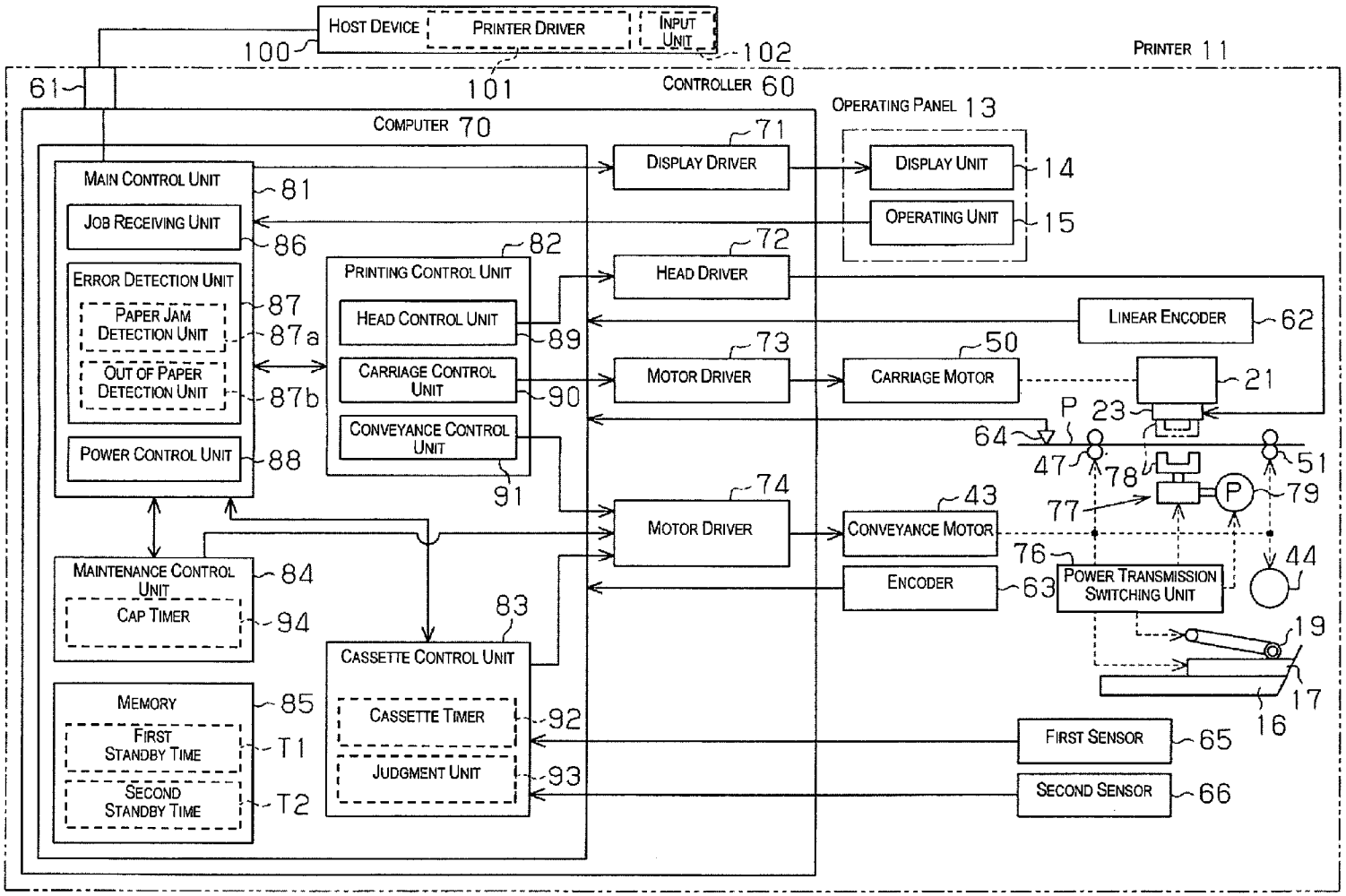
FIG. 6 is a block diagram showing the electrical configuration of the printer.

Next, we will describe the electrical configuration of the printer 11 based on FIG. 6. As shown in FIG. 6, the printer 11 is equipped with a controller 60 in charge of the various controls. The controller 60 is connected to be able to communicate with a host device 100 via a communication interface 61. The controller 60 controls the printing operation and the like of the printer 11 based on the print job data received from the host device 100. The host device 100 includes a personal computer or the like, and has a built in printer driver 101. The host device 100 is equipped with an input unit 102 including a keyboard and mouse, and by the user operating the input unit 102, he inputs printing condition information on the setting screen displayed by the printer driver 101 on a monitor (not illustrated). The printing condition information includes paper type, paper size, print color, print quality and the like. The printer driver 101 generates print image data of the image for which printing execution was specified based on the printing condition information, and generates print job data with a header attached that includes a portion of the printing condition information and sends it to the printer 11. With this example, the printing condition information contained in the header includes at least the paper type and paper size.

As an output system, the display unit 14, the carriage motor 50, and the conveyance motor 43 are connected to the controller 60. Also connected to the controller 60 as the input system are the operating unit 15 that includes the power switch 15*a*, a linear encoder 62, an encoder 63 (e.g. a rotary encoder), a paper detection sensor 64, and as examples of detection units, a first sensor 65 and a second sensor 66.

As shown in FIG. 6, the controller 60 is equipped with a computer 70, a display driver 71, a head driver 72, and motor drivers 73 and 74. The computer 70 drives the recording head 23 via the head driver 72 based on print job data (hereafter also simply called "print job"), and draws an image or the like on the paper P based on the print image data by spraying ink drops. Also, the computer 70 drives and controls the carriage motor 50 via the motor driver 73, and controls movement of the carriage 21 in the main scan direction X. At this time, the computer 70 grasps the movement position with the home position of the carriage 21 as a source point, for example, by calculating the input pulses from the linear encoder 62 using a counter (not illustrated). With this embodiment, one example of a recording job is constituted by a print job.

Furthermore, the computer 70 drives and controls the conveyance motor 43 via the motor driver 74. Here, a power transmission switching unit 76 (clutch unit) is interposed on the power transmission path by which the power of the conveyance motor 43 is transmitted. The power transmission switching unit 76 has a switching lever (not illustrated) arranged on the movement path of the carriage 21, and in a state with the carriage 21 pressing the switching lever, the conveyance motor 43 is switched to a switching position according to the rotation position by being driven by a designated rotation volume. The conveyance motor 43 is always connected with the feed drive roller 44, the conveyance driver roller 47, and the first roller 51. With four of the switching positions among the plurality of switching positions of the power transmission switching unit 76, the power from the conveyance motor 43 is connected respectively to the upper cassette 17, the pickup roller 19, the cap 78 of the maintenance device 77, and the suction pump 79.

In a state with the power transmission switching unit 76 in the cassette switching position shown in FIG. 6, when the conveyance motor 43 is rotated in the normal direction, the pinion gear 33 (see FIG. 3) rotates in the normal direction, and via the engagement of this normal rotation pinion gear 33 and the rack unit 17*d*, the upper cassette 17 moves in the direction from the removal position inside the device main unit 12 toward the feed position. Meanwhile, when the conveyance motor 43 is rotated in the reverse direction, the pinion gear 33 rotates in reverse, and via the engagement of this reverse rotating pinion gear 33 and the rack unit 17*d*, the upper cassette 17 moves in the direction from the feed position inside the device main unit 12 toward the removal direction.

The encoder 63 outputs to the computer 70 a detection pulse signal having a number of pulses proportional to the rotation volume of the conveyance motor 43. Also, the first sensor 65 turns on when the upper cassette 17 is in a state in the removal position (FIG. 4), and is off when not in the removal position. Also, the second sensor 66 is on in a state with the upper cassette 17 in the feed position (FIG. 5), and is off when not in the feed position. With this embodiment, an example of the drive unit is constituted by the conveyance motor 43 for driving the upper cassette 17 and the motor driver 74.

The maintenance device 77 shown in FIG. 6 is arranged below the home position at which the recording head 23 waits when not printing, and does maintenance of the recording head 23. The maintenance device 77 has the cap 78 and the suction pump 79. The cap 78 moves between the capping position at which it abuts the nozzle forming surface of the recording head 23 that waits at the home position, and a retraction position separated from the nozzle forming surface of the recording head 23. Then, when the power transmission switching unit 76 is at the cap switching position, the power of the conveyance motor 43 is transmitted to the cap 78, making possible the rise and fall operation of the cap 78. Also, when the power transmission switching unit 76 is in the pump switching position, the power of the conveyance motor 43 is transmitted to the suction pump 79, and the suction pump 79 is driven to pump. When the suction pump 79 is driven with the cap 78 in a state abutting the nozzle forming surface of the recording head 23, the interior of the cap 78 goes to negative pressure, and ink is suctioned from the nozzles of the recording head 23, and by doing this, cleaning of the nozzles is performed. Also, when the recording head 23 is waiting at the home position, by capping the cap 78 on the nozzle forming surface of the recording head 23, clogging of the nozzles due to thickening or drying of the ink inside the nozzles is prevented.

Figure 7:
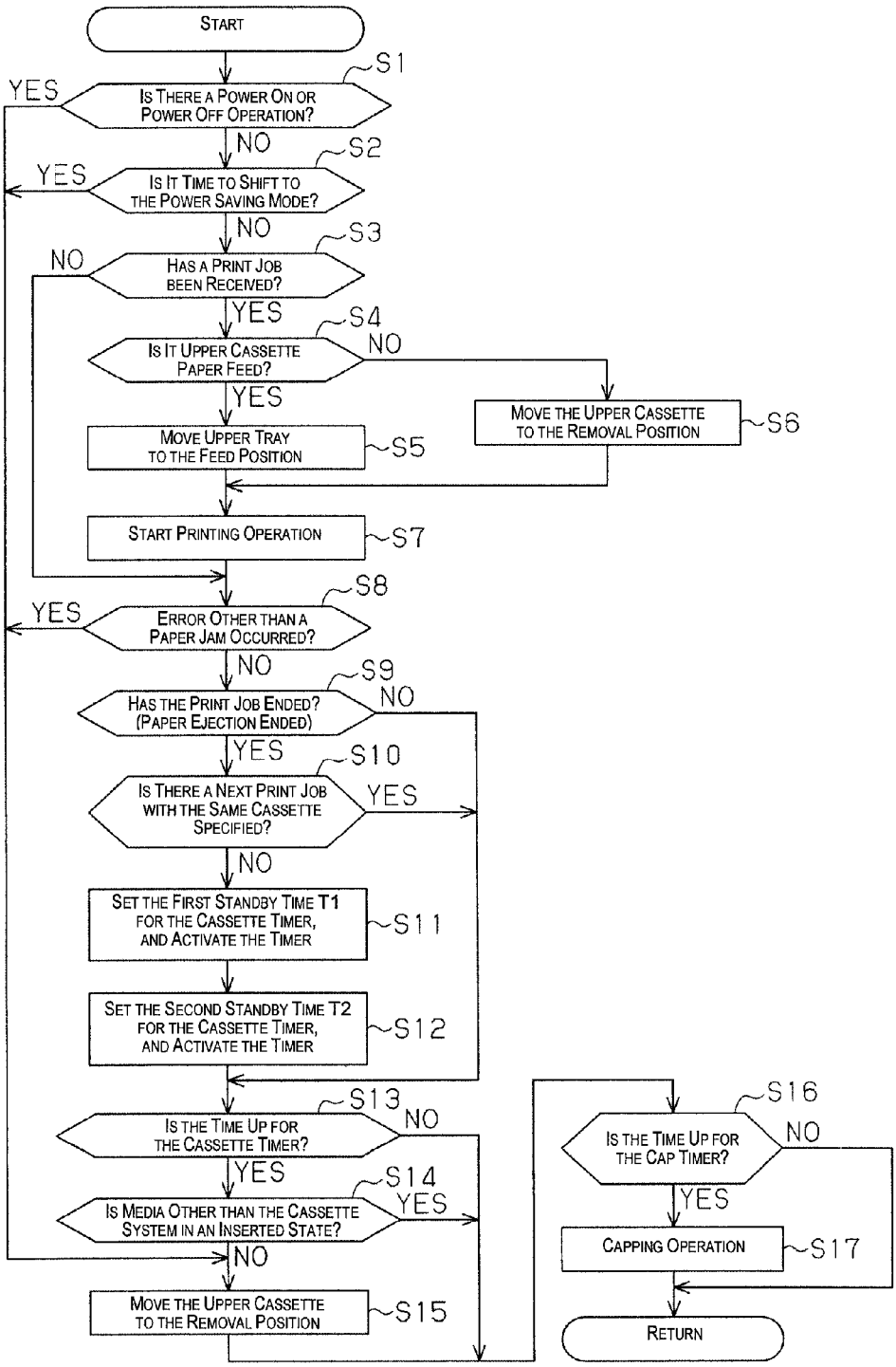
FIG. 7 is a flow chart showing the cassette control routine.
Figure 8:
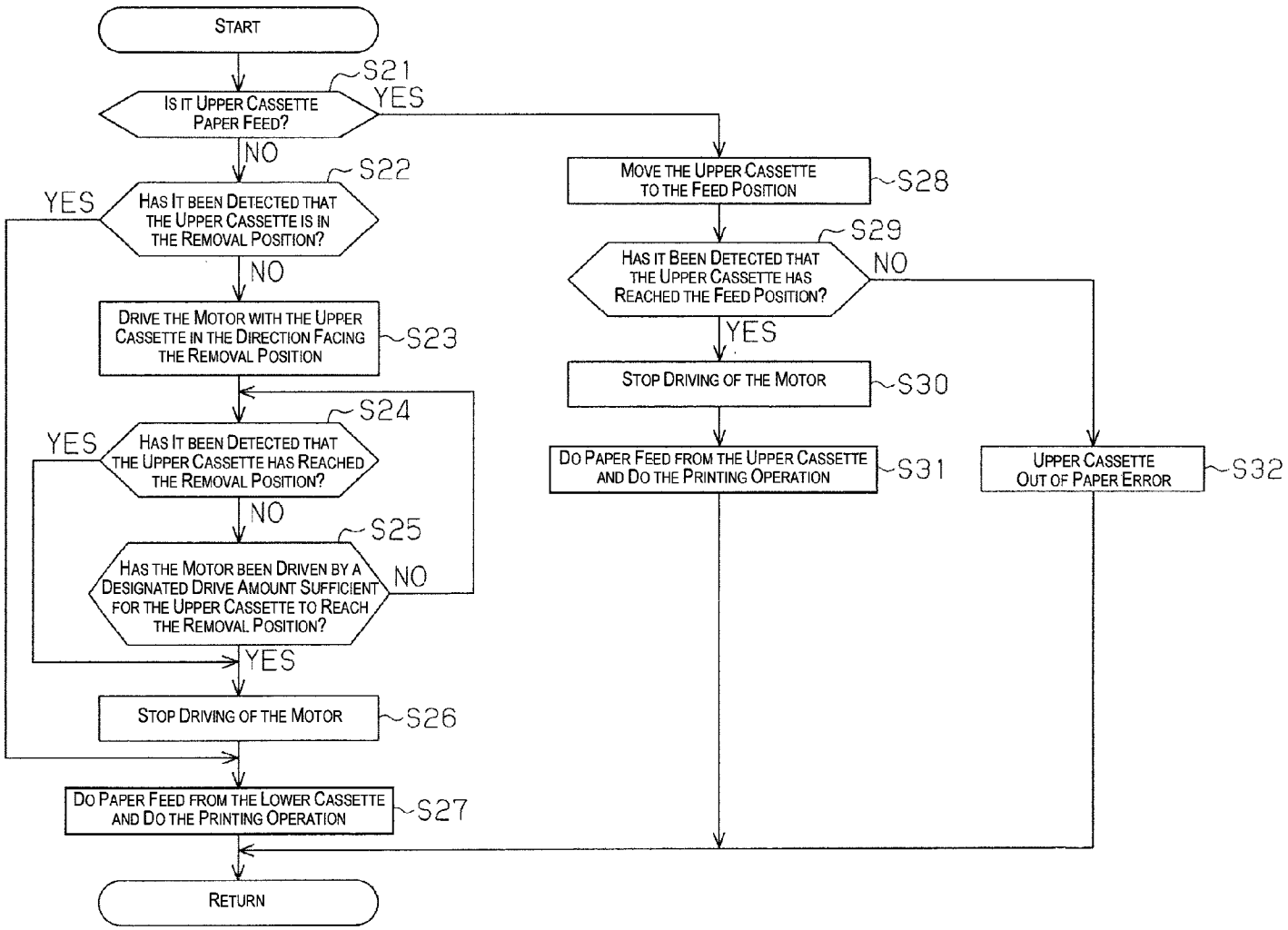
FIG. 8 is a flow chart showing a detailed subroutine of a portion of the cassette control.
Figure 9:
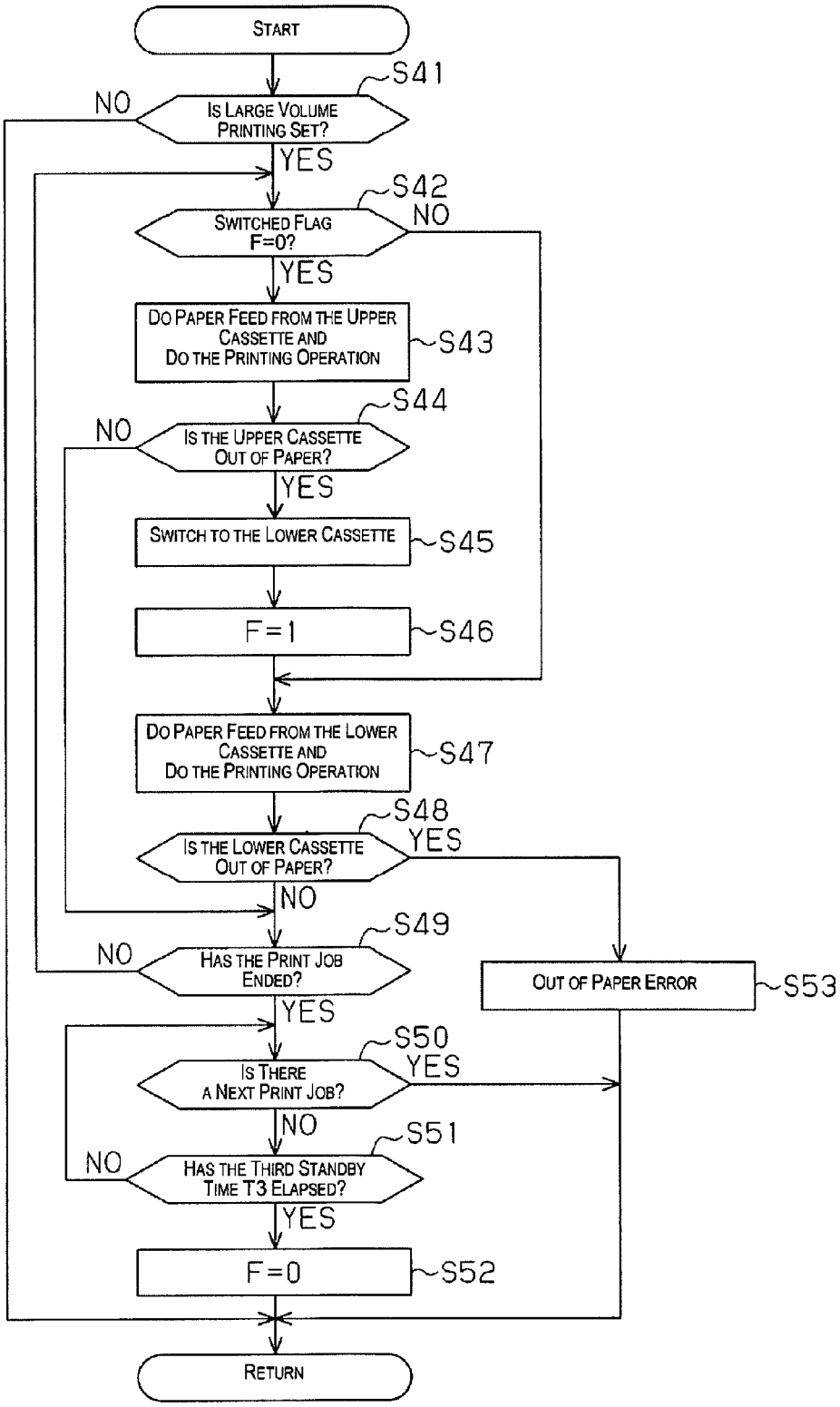
FIG. 9 is a flow chart showing a large volume printing control routine.

The computer 70 shown in FIG. 6 is constituted equipped, for example, with a CPU, ASIC (Application Specific IC (ICs for specific applications)), RAM, ROM, non-volatile memory and the like. Stored in the ROM or non-volatile memory are various types of programs including cassette control system programs shown in the flow charts in FIG. 7 through FIG. 9. FIG. 7 shows a cassette control routine for performing the cassette control of moving the upper cassette 17, and FIG. 8 shows a cassette control subroutine showing a detailed portion of the cassette control. Also, FIG. 9 shows a large volume printing routine for performing printing of a large volume (large number of sheets) exceeding the volume of one cassette, for example, using paper P of both cassettes 16 and 17, with the same paper size paper P housed in both the lower cassette 16 and the upper cassette 17.

The computer 70 is equipped with a plurality of functional units shown in FIG. 6 including software constructed by the CPU executing programs stored in the ROM or non-volatile memory. Specifically, as the plurality of functional units, the computer 70 is equipped with a main control unit 81, a printing control unit 82, and a cassette control unit 83 and a maintenance control unit 84 as one example of a control unit. Also, the computer 70 is equipped with a memory 85 for storing various types of data needed for various types of controls. Of course, each functional unit is not limited to being a software constitution using the computer 70, and it is also possible to have a hardware constitution such as electronic circuits (e.g. custom ICs) or the like, or a constitution using cooperation between software and hardware.

As shown in FIG. 6, the main control unit 81 is equipped with a job receiving unit 86, an error detection unit 87, and a power control unit 88. The job receiving unit 86 receives print job data from the host device 100, and receives print job data for printing image data input to the printer 11 from a portable memory device such as a memory card, USB memory or the like connected to the printer 11. Paper size information is included in this print job data.

The error detection unit 87 has the function of detecting errors of the printer 11. The error detection unit 87 is equipped with a paper jam detection unit 87*a* as an example of a media jam error detection unit for detecting paper jams of paper P as an example (media jam error), an out of paper detection unit 87*b* as an example of a media presence detection unit for detecting that the paper P inside the cassettes 16 and 17 has run out so they're empty, and the like. With FIG. 6, error detection functional units other than the paper jam detection unit 87*a* and the out of paper detection unit 87*b* are omitted. As other errors, the error detection unit 87 also detects paper size errors by which the specified paper size and the actual paper size are different (media size error), cassette errors by which the necessary cassette is not mounted, ink end errors by which the ink of the ink cartridge has run out, and the like. Here, for paper size error, the error detection unit 87 detects the paper size specified by the print job data, judges whether or not the actual paper size matches, and when not a match, detects a paper size error. As the actual paper size detection method, an example of a method is to provide sensors capable of detecting the paper guide position provided on each cassette 16 and 17, detect the paper size using these sensors, detect the paper width of the fed paper using a paper width sensor provided on the carriage 21, and estimate the paper size from that detected paper width.

Here, the out of paper detection unit 87*b* detects being out of paper based on the fact that paper was not detected by the paper detection sensor 64, despite the conveyance motor 43 being driven by a designated rotation volume sufficient for the edge of the paper to reach the detection area of the paper detection sensor 64 from the point that paper feed started. Also, the paper jam detection unit 87*a* detects paper jams based on the fact that the paper detection sensor 64 is in a paper detection state despite the conveyance motor 43 being driven by a designated rotation volume sufficient for the back end of the paper to separate from the detection area of the paper detection sensor 64 with the paper ejection operation after printing on the paper ends. Of course, it is also possible to provide a paper presence sensor in each cassette 16 and 17 and detect being out of paper for each cassette 16 and 17 using this paper presence sensor. In this way, with a constitution providing a paper presence sensor, it is possible to also use a detection method using paper jams when the paper detection sensor 64 does not detect paper despite the conveyance motor 43 being driven by a designated rotation volume sufficient for the edge of the paper to reach the detection area of the paper detection sensor 64 from the time that paper feeding starts.

The power control unit 88 controls the supply of power to each unit within the printer 11. The printer 11 of this embodiment has a normal mode and a power saving mode as the modes relating to power. After the printing operation ends, when left in a state with no operation of the operating unit 15 by the user, when a state with no operation by the printer 11 continues for a designated time, the power control unit 88 judges that power saving conditions are established, and shifts from normal mode to power saving mode. In the power saving mode, the supply of power is temporarily stopped to the printing system (recording head 23, motors 34, 43, 50 and the like), the display system (display unit 14 and the like), the sensor system (sensors 64, 65, and 66, and encoders 62 and 63) and the like, and as an example, only the minimum necessary power is supplied to the CPU, the operating unit 15, the communication interface 61 and the like. Then, when an operation of the operating unit 15 by the user is detected, or printer operation instructions are received, the power control unit 88 shifts from the power saving mode to the normal mode, and supplies power to the printing system, the display system, the sensor system and the like. Of course, it is also possible to set a standby mode of darkening the display unit 14 or the like during the normal mode and the power saving mode.

Also, the printing control unit 82 shown in FIG. 6 is equipped with a head control unit 89, a carriage control unit 90, and a conveyance control unit 91. The head control unit 89 controls the recording head 23 via the head driver 72 based on the print image data received from the main control unit 81, and performs control by having the recording head 23 spray ink drops.

The carriage control unit 90 controls driving of the carriage motor 50 via the motor driver 73, and controls movement of the carriage 21 in the main scan direction X. Also, the carriage control unit 90 drives the carriage motor 50 for the switching operation of the power transmission switching unit 76 by the carriage 21. The carriage control unit 90 grasps the position of the main scan direction X with the home position of the carriage 21 as the source point, for example, from the calculation value calculated by the counter (not illustrated) of input pulses from the linear encoder 62.

The conveyance control unit 91 does drive control of the conveyance motor 43 via the motor driver 74, and controls feeding and conveyance of the paper P. The power of the conveyance motor 43 is transmitted to the feed drive roller 44, the conveyance drive roller 47, and the first roller 51 via the power transmission path including a gear train, and the paper P is fed and conveyed by the rollers 44, 47, and 51 rotating by that transmitted power. This conveyance motor 43 is also used for switching of the power transmission switching unit 76, and in a state with the carriage 21 pressing the lever, the conveyance motor 43 is driven by an amount of rotation correlating to the difference between the rotation position of the current switching position and that of the next switching position. For example, when the conveyance motor 43 is driven in a state with the power transmission switching unit 76 in the cassette switching position, the pickup roller 19 rotates and paper feed is performed. Also, when the conveyance motor 43 is driven in a state with the power transmission switching unit 76 in the cap switching position, the cap 78 of the maintenance device 77 rises and falls, and for example when the cap 78 rises from the retraction position, the recording head 23 is capped by the cap 78. Furthermore, when the conveyance motor 43 is driven in a state with the power transmission switching unit 76 in the pump switching position, the suction pump 79 of the maintenance device 77 is driven, and for example in the capped state, the suction pump 79 performs cleaning of the nozzles by the pump being driven.

The cassette control unit 83 shown in FIG. 6 moves the upper cassette 17 in the attaching and detaching direction by doing drive control of the conveyance motor 43 via the motor driver 74 in a state with the power transmission switching unit 76 in the cassette switching position. In a state with the upper cassette 17 in the removal position (state with the first sensor 65 on), by the cassette control unit 83 having the conveyance motor 43 rotate in the normal direction, the upper cassette 17 is moved from the removal position toward the feed position. At this time, when the upper cassette 17 separates from the removal position, the first sensor 65 switches from on to off. Furthermore, when the upper cassette 17 reaches the feed position, the second sensor 66 switches from off to on. When the second sensor 66 switches from off to on, by the cassette control unit 83 stopping driving of the conveyance motor 43, the upper cassette 17 stops at the feed position.

Also, by the cassette control unit 83 rotating the conveyance motor 43 in the reverse direction with the upper cassette 17 in a state in the feed position (state with the second sensor 65 on), the upper cassette 17 is moved from the feed position toward the removal position. At this time, when the upper cassette 17 separates from the feed position, the second sensor 66 switches from on to off. Furthermore, when the upper cassette 17 reaches the removal position, the first sensor 65 switches from off to on. When the first sensor 65 switches from off to on, by the cassette control unit 83 stopping driving of the conveyance motor 43, the upper cassette 17 stops at the removal position.

The cassette control unit 83 is equipped with a cassette timer 92 and a judgment unit 93. With this example, the cassette timer 92 performs timing of the time from the print job end time until the elapsed time reaches a first standby time T1. The cassette timer 92 is constituted from a counter, for example. When the cassette control unit 83 receives from the printing control unit 82 notification to the effect that the paper ejection operation has ended after printing of an image based on the print job (e.g. final page) has ended, the first standby time T1 is set for the cassette timer 92, and the countdown starts. Then, when the time is up for this cassette timer 92, the cassette control unit 83 performs control to move the upper cassette 17 from the feed position to the removal position. Also, the judgment unit 93 performs various types of judgment processes that are needed when performing cassette control that controls the position of the upper cassette 17.

Selection of one of the lower cassette 16 and the upper cassette 17 to use for feeding is performed by the user activating the printer driver 101 of the host device 100 and operating the input unit 102 with the setting screen in a state displayed on the monitor, or by operating the operating unit 15 in a state with the setting screen displayed on the display unit 14 of the printer 11. This operation can be constituted by doing one selection specification from among the plurality of cassettes 16 and 17 on the setting screen, or when the specification information including at least the paper size is specified, can also be constituted by the printer driver 101 selecting one from among the cassettes 16 and 17 based on that specification information.

The maintenance control unit 84 shown in FIG. 6 performs various types of maintenance relating to the recording head 23 by driving the maintenance device 77. The maintenance control unit 84 selects the cap and pump switching positions by switching the power transmission switching unit 76 by operation of the carriage 21, and by driving the conveyance motor 43 at the respective switching positions, moves the cap 78 or drives the suction pump 79. The maintenance control unit 84 is equipped with a cap timer 94 that times the elapsed time from the time the print job ends until the second standby time T2 is reached. The cap timer 94 is constituted using a counter, for example. The same as with the cassette control unit 84, when cap timer 94 receives notification to the effect that the print job (e.g. final page paper ejection operation) has ended from the printing control unit 82, the second standby time T2 is set for the cap timer 94, and the countdown starts. The maintenance control unit 84 moves the cap 78 from the retraction position to the capping position when the time is up with the cap timer 94, and caps the recording head 23. With this embodiment, the first standby time T1 is set to a value shorter than the second standby time T2 (T1<T2).

The memory 85 includes of RAM or non-volatile memory, for example, or can be constituted from both of these. Reference data needed for the control units 81 through 84 to perform various controls and the calculation results of the control units 81 through 84 are temporarily stored in the memory 85. With this example, each data of the first standby time T1 and the second standby time T2 is stored in the memory 85.

For example, with a portion of the spreadsheet software used with the host device 100 (e.g. Excel (made by Microsoft)), when performing multiple page printing, a process is done of creating one print job data for each page, so a plurality of print job data (one page portion) is received intermittently. In this case, after the print job ends, when the next print job is received with a slight time gap (e.g. 0.5 seconds to 1 second) opened, regardless of this being a print series, this is judged as not having a next print job, and there is the problem that the upper cassette 17 is returned from the feed position to the removal position. In light of this, with this embodiment, even when a print job is received with a slight time gap open in this type of print series, the previously described first standby time T1 is set such that the operation of moving the upper cassette 17 from the feed position to the removal position does not start. Then, with this example, as the first standby time T1, for example 2 seconds is set so as to be as short as possible including a margin, considering the communication speed with the host device 100. Then, if there is a 2 second first standby time T1, with this type of multiple page printing, even when one page amount each of print job data is received, this is judged as having the next print job data, and having the upper cassette 17 be returned to the removal position is avoided. Then, if the next print job data is not received even when the 2 second first standby time T1 is waited, it is possible to regard this as the series of printing up to then having ended.

With this embodiment, in addition to the point at which the first standby time T1 has elapsed from the end of the print job, the cassette preparation operation of moving the upper cassette 17 to the removal position is also performed during the power switch 15*a* on operation, the off operation, when an error occurs (this excludes paper jam errors, however), and when moving to power saving mode. Following is the reason why the cassette preparation operation is performed with this timing. This is because during the operation of turning the power switch 15*a* on, after the on operation, there is a possibility of the user replenishing paper P2 in the upper cassette 17. This is also because during the operation of turning off, there is a possibility of the user replenishing paper P2 in the upper cassette 17 when the power of the printer 11 is off. This is also because when an error occurs (paper jam errors are excluded, however), there is a possibility that to resolve the error (e.g. an out of paper error or paper size error), the user will replenish the paper P2 in the upper cassette 17 or will replace the paper 2 with another paper size. However, when there is a paper jam error, when the upper cassette 17 is moved, there is concern that the conveyance system which has a common power source (conveyance motor 43) can be driven, and instead the paper jam will get worse, so it is set so that the upper cassette 17 is not moved. Also, when shifted to the power saving mode, in a state with the sensors off and not doing monitoring, it is possible that the user will replenish the paper P2 in the upper cassette 17 in this state, so moving of the upper cassette 17 to the removal position is also implemented at the point of shifting to the power saving mode (before shifting).

Furthermore, with this embodiment for which the power is shared by the upper cassette 17 and the conveyance system, when media exists in the conveyance system other than the cassette system inside the device main unit 12, and when paper P is inserted from the manual feed port 53, not performing the cassette preparation operation is a prohibitive condition. In the label printing mode that prints on the label part of a storage disk such as a CDR, DVD or the like, the tray (not illustrated) in which the storage disk is set is inserted inside the device main unit 12. When the cassette preparation operation is performed during the label printing mode, the position of the tray inserted in the device main unit 12 is skewed. Also, when the cassette preparation operation is performed in the manual printing mode, the position of the paper P inserted from the feed port 53 is displaced, and there is concern that the paper P will bend during that displacement. Because of this, with this embodiment, in a state with a media other than of the cassette system inserted in the device main unit 12, the cassette preparation operation is prohibited.

Next we will describe the action of the printer 11. When the printer 11 is activated (when in a power on state), in addition to the printing control executed when a print job is received, the computer 70 executes the cassette control routine shown in the flow chart in FIG. 7, the cassette control subroutine shown in the flow chart in FIG. 8, and the large volume printing processing routine shown in the flow chart in FIG. 9. First, we will describe the cassette control based on the flow chart in FIG. 7.

Cassette Control Routine

The computer 70 executes the cassette control routine shown in the flow chart in FIG. 7 when the printer 11 power is on. The process relating to control of the upper cassette 17 with this cassette control is executed mainly while the cassette control unit 83 within the computer 70 is performing judgment processing and the like based on information from the other control units 81 and 82.

First, at step S1, a judgment is made of whether there is a power on or power off operation. Specifically, it is judged that there is a power on operation when the operation of the power switch 15*a* by the user is detected in a power off state of the printer 11, and it is judged that there is a power off operation when it is detected that there is a power switch 15*a* operation by the user when the printer 11 is in a power on state. When it is judged that there is a power on or power off operation, the process advances to step S2, and when it is not judged that there was that operation, the process advances to step S15.

Next, at step S2, a judgment is made of whether there is a shift to the power saving mode. Specifically, when a power mode shift notification notifying a shift to the power saving mode is received from the main control unit 81 which controls the power modes controlled by the power control unit 88, the judgment unit 93 judges this to be a time of a shift to the power saving mode, and when there is no power saving mode shift notification, it judges that it is not a time of a shift to the power saving mode. If it is not the time of a shift to the power saving mode, the process advances to step S3, and if it is the time of a shift to the power saving mode, it advances to step S15.

At step S3, a judgment is made of whether a print job has been received. When the job receiving unit 86 receives unexecuted print job data, and it is possible to execute that print job immediately, the main control unit 81 notifies the cassette control unit 83 that a job was received. When there is a job received notification, the judgment unit 93 judges that a print job has been received, and when there is no job received notification, it judges that a print job has not been received. When a print job has been received, the process advances to step S4, and when a print job has not been received, the process advances to step S8.

At step S4, a judgment is made of whether this is upper cassette paper feed. Cassette specification information that specifies the used feed cassette is included in the print condition information in the print job data received by the job receiving unit 86. The judgment unit 93 judges whether the feed cassette used for paper feeding is the upper cassette 17 based on the cassette specification information fetched from the main control unit 81. When it is upper cassette paper feed, the process advances to step S5, and when it is not upper cassette paper feed, but rather is lower cassette paper feed, the process advances to step S6.

At step S5, the upper cassette moves to the feed position. Specifically, the cassette control unit 83 drives the conveyance motor 43 to rotate in the normal direction, and moves the upper cassette 17 from the removal position to the feed position. At this time, the upper cassette 17 pushes away the oscillating member 20 in the process of the upper cassette 17 moving to the feed position, and when it reaches the feed position, the pickup roller 19 abuts the top surface of the paper P2 within the upper cassette 17.

At step S6, the upper cassette moves to the removal position. Specifically, the cassette control unit 83 drives the conveyance motor 43 to rotate in the reverse direction, and the upper cassette 17 is moved from the feed position to the removal position. At this time, in the process of the upper cassette 17 moving to the removal position, the oscillating member 20 releases its engagement with the upper cassette 17, and the pickup roller 19 drops and abuts the top surface of the paper P1 within the lower cassette 16.

Next, at step S7, the printing operation starts. Specifically, the printing control unit 82 first performs paper feed by the conveyance control unit 91 driving the conveyance motor 43. After that, the carriage control unit 90 and the head control unit 89 are driven, and the recording operation is performed by performing one line of printing by spraying ink drops from the recording head 23 in the process of the carriage 21 moving in the main scan direction X. Then, the recording operation and paper feed are performed roughly alternately to perform printing of an image on the paper P. When the printing operation starts in this way at step S7, the process hereafter proceeds during this printing operation.

At step S8, a judgment is made of whether an error other than a paper jam occurred. The main control unit 81 monitors the error detection state of the error detection unit 87, and when the error detection unit 87 detects an error, an error notification is given together with the error content information from the main control unit to the cassette control unit 83. When there is an error notification, the judgment unit 83 specifies the error contents based on the error content information, and judges whether the specified error is other than a paper jam. Then, if the error contents for which there was an error notification is other than a paper jam (an example would be being out of paper detected by the out of paper detection unit 87*b*, a paper size error or the like), the judgment unit 93 judges that an error other than a paper jam has occurred. Meanwhile, when there is no error notification, and when the error contents when there is notification is a paper jam, the judgment unit 93 judges that an error other than a paper jam has not occurred. Then, when an error other than a paper jam has not occurred, the process advances to step S9, and when an error other than a paper jam has occurred, the process advances to step S15.

At step S9, a judgment is made of whether a print job has ended. Here, a judgment is made of whether the paper ejection operation of the final page of the print job has ended. When the printing operation of the final page of the print job has ended, the printing control unit 82 performs the paper ejection operation of ejecting the paper. At this time, the paper ejection operation is until the driving of the conveyance motor 43 by an amount of a designated rotation volume ends in addition to a margin amount for the conveyance amount necessary for having no nipping of the paper P between the rollers 51 and 52 of the forwarding unit 39. The printing control unit 82 ends the print job based on ending of the paper ejection operation of the final page. When the print job ends, print job end notification is given from the printing control unit 82 to the cassette control unit 83. When there is a print job end notification, the judgment unit 93 judges that the print job has ended, and if there is no print job end notification, judges that the print job has not ended. When the print job has ended, the process advances to step S10, and when the print job has not ended, it advances to step S13.

At step S10, a judgment is made of whether there is a next print job for which the same cassette is specified. Specifically, when judging the presence of the next job and there is a next job, a judgment is made of whether the used feed cassette is the same as that of the print job up to that point based on the printing condition information. When there is no next print job with the same cassette specified, in other words, when there is no next print job, and even when there is a next print job, the feed cassette is not the same cassette, the process advances to step S11. Meanwhile, when there is a next print job with the same cassette specified, the process advances to step S13.

At step S11, the first standby time T1 is set for the cassette timer 92, and the timer is activated. This cassette timer activation process is performed by the cassette control unit 83. Next, at step S12, the second standby time T2 (>T1) is set for the cap timer 94, and the timer is activated. This cap timer activation process is performed by the maintenance control unit 84.

Next, at step S13, a judgment is made of whether the time is up with the cassette timer 92. This judgment process is performed by the cassette control unit 83. When the first standby time T1 time is up with the cassette timer 92, the process advances to step S14, and when the first standby time T1 time is not up, it advances to step S16.

At step S14, a judgment is made of whether a media other than the cassette system is in an inserted state. The main control unit 81 manages whether the current printing mode is in the normal printing mode of printing with feeding of paper from the cassettes 16 and 17 (cassette system printing mode), the manual paper feed mode, or the label printing mode for printing on the label part of a storage disk based on the printing condition information in the print job data or the printing condition information set using the operating panel 13. The cassette control unit 83 receives notification of the current printing mode from the main control unit 81. Then, if the current print mode is the cassette system normal print mode, the judgment unit 93 judges that it is not in a state with media other than the cassette system (hand fed paper or a disk tray in which a storage disk is set) inserted on the conveyance path, and if it is in the hand feeding print mode or the label printing mode, it judges it to be in a state for which a media other than the cassette system is inserted in the conveyance path. The reason this judgment is performed is to avoid the problem of the position on the conveyance path from being skewed when media is conveyed on a conveyance path for printing in another printing mode, with the conveyance system driven by the power of the conveyance motor 43 when it's driven to move the upper cassette 17 in a state with the media other than the cassette system inserted inside the conveyance path. Then, if not in a state with a media other than the cassette system inserted, the process advances to step S15, and when in a state with a media other than the cassette system inserted, it advances to step S16.

At step S15, the upper cassette 17 moves to the removal position. Specifically, the cassette control unit 83 drives the conveyance motor 43 to rotate in the reverse direction and moves the upper cassette 17 to the removal position. At this time, when the first sensor 65 is turned on during driving of the conveyance motor 43 in the reverse direction, by stopping the driving of the conveyance motor 43, the upper cassette 17 is stopped at the removal position.

At step S16, a judgment is made of whether the time is up for the cap timer 94. This judgment process is performed by the maintenance control unit 84. When the second standby time T2 time is up for the cap timer 94, the process advances to step S17, and when the second standby time T2 time is not up, the concerned routine ends.

At step S17, the capping operation is performed. Specifically, the maintenance control unit 84 drives the conveyance motor 43, and by moving the cap 87 from the retraction position to the capping position, the recording head 23 is capped. At this time, the carriage 21 moves to the home position at the end of the printing job and waits, and at this time, the power transmission switching unit 76 is in the cap switching position. Because of this, if the conveyance motor 43 is driven to rotate in the reverse direction, for example, the cap 78 rises and the recording head 23 is capped.

For example, during printing after the start of the printing operation, even if the next print job is received it can't be executed, so this is regarded as the print job to be executed not being received (affirmative judgment at S4), and since no error occurs (affirmative judgment at S8), and time up does not occur since the timers 92 and 94 are not activated (negative judgment at both S13 and S16), that routine ends. Because of this, the computer 70 executes that routine at every interval of a designated time.

For example, when an error other than a paper jam occurs during printing (affirmative judgment at S8), the upper cassette 17 is moved to the removal position (S15). Because of this, for example, when an out of paper error occurs, the upper cassette 17 is promptly moved to the removal position, so the user is able to pull out the upper cassette 17 that is in the removal position and replenish the paper P2 without having to wait. Also, when a paper jam error occurred during printing (negative judgment at S8), that routine ends. At this time, an error flag is set, and until the error is resolved and the error flag is reset, this routine does not start. Thus, when a paper jam error occurs, the upper cassette 17 does not move to the removal position. Because of this, by driving the conveyance motor 43 to rotate in the reverse direction by moving the upper cassette 17 to the removal position, each roller 47 of the conveyance system is driven, and it is possible to avoid the situation of the paper jam becoming worse.

Also, when the print job ends (affirmative judgment at S9), if there is no next print job for which the same cassette is specified at this time (negative judgment at S10), the first standby time T1 is set for the cassette timer 92 and the timer is activated (S11), and also the second standby time T2 (>T1) is set for the cap timer 94 and the timer is activated (S12). Then, when the first standby time T1 elapses from the time the print job ends (negative judgment at S13), if media other than the cassette system is not in an inserted state at that time (negative judgment at S14), the upper cassette 17 moves to the removal position. Then, when more time elapses after that, and the second standby time T2 elapses from the time the print job ends, the cap 78 is made to abut the recording head 23 and the capping operation is performed. At this time, after the print job ends, it is possible to move the upper cassette 17 to the removal position at the point that the shorter first standby time T1 has elapsed rather than wait for the second standby time T2 which is the capping timing.

Also, even in the case of continuous printing when one job is one page, even when the next job is delayed, the first standby time T1 is set to a short time (e.g. 2 seconds) in order to add a slight margin to almost the shortest time for which receiving is possible. Because of this, it is possible to avoid the problem of the upper cassette 17 being moved from the feed position to the removal position midway in this type of continuous printing.

In a case when printing using the lower cassette 16 as well, if there is no next print job for which the next cassette is specified, when the first standby time T1 has elapsed from the time the print job ended, the upper cassette 17 is moved to the removal position. The lower cassette 16 was being used at this time, so the upper cassette 17 is already in the removal position, but there are cases when the user accidentally pushed in the upper cassette 17 during the previous printing. Because of this, with this embodiment, the upper cassette 17 is arranged more reliably at the removal position, so the operation of moving the upper cassette 17 to the removal position is performed.

Also, when the print job has ended (affirmative judgment at S9), if there is a next print job for which the same cassette has been specified at this time (affirmative judgment at S10), the upper cassette 17 is held in the feed position without being moved to the removal position. Because of this, it is possible to quickly start the next print job. At this time, when the upper cassette 17 was used for paper feed with the previous print job, the upper cassette 17 is held in the feed position. Meanwhile, when the lower cassette 16 was used for paper feed with the previous print job, the upper cassette 17 is held in the removal position.

Also, after the print job ends, when the user operates the power switch 15*a* when the printer 11 power is on, it is judged that there was a power off operation (affirmative judgment at S1). At this time, the upper cassette 17 is promptly moved to the removal position (S15). Because of this, even when the printer 11 power is off, it is possible for the user to replenish paper P2 in the upper cassette 17.

Also, when the user operates the printer 11 power switch 15*a* when the power is off, it is judged that there was a power on operation (affirmative judgment at S1). At this time, the upper cassette is promptly moved to the removal position (S15). Because of this, when the user pushed in the upper cassette 17 for any reason when the printer 11 power is off, the upper cassette 17 is arranged in the removal position when the power is on, so for example immediately after activating the printer 22, it is possible for the user to replenish the paper P2 in the upper cassette 17.

Furthermore, after the print job ends, when the printer 11 is shifted to the power save mode (affirmative judgment at S2), the upper cassette 17 is promptly moved to the removal position (S15). Because of this, even when the printer 11 is in the power save mode, the user is able to replenish the paper P2 in the upper cassette 17.

Cassette Control Subroutine

Next, we will describe the cassette control subroutine based on FIG. 8. This subroutine is shown in detail with the process of steps S4 through S7 in the cassette control routine of FIG. 7, and even when the upper cassette 17 is not mounted in the cassette housing recess 26 of the printer 11, paper feed is realized without error from the lower cassette 16. When the computer 70 receives the print job (affirmative judgment at step S4 in FIG. 7) and the processes of steps S4 through S7 of FIG. 7 are performed, the program shown in the flow chart in FIG. 8 is read from the memory 85 and executed. Step S21 of FIG. 8 correlates to step S4 in FIG. 7.

Hereafter, we will describe in detail the cassette control for the printer 11 according to FIG. 8. First, at step S21 (correlating to S4 in FIG. 7), when it is lower cassette paper feed (negative judgment at S21), a judgment is made of whether it is detected that the upper cassette 17 is in the removal position (S22). If the first sensor 65 is in an on state and it is detected that the upper cassette 17 is in the removal position, paper is fed as is from the lower cassette 16 and the printing operation is performed (S27). Meanwhile, if it is not detected that the upper cassette 17 is in the removal position, the conveyance motor 43 is driven in the direction for which the upper cassette 17 goes toward the removal position (with this example, the reverse rotation direction) (S23). Then, during this driving of the conveyance motor 43, a judgment is made of whether it is detected that the upper cassette 17 has reached the removal position (S24). While it is not detected that the upper cassette 17 has reached the removal position (negative judgment at S24), a judgment is made of whether the conveyance motor 43 was driven by a designated drive amount sufficient for the upper cassette 17 to reach the removal position (S25). Then, if it is detected that the upper cassette 17 has reached the removal position (affirmative judgment at S24), the driving of the conveyance motor 43 is stopped (S26), and paper is fed from the lower cassette 16 and the printing operation is performed.

Meanwhile, even when it is not detected that the upper cassette 17 has reached the removal position (negative judgment at S24), when the conveyance motor 43 has been driven by a designated drive amount sufficient for the upper cassette 17 to reach the removal position (affirmative judgment at S25), the driving of the conveyance motor 43 is stopped (S26). In other words, when the upper cassette 17 is not mounted in the printer 11, even when the conveyance motor 43 is driven by a designated drive amount sufficient for the upper cassette 17 to reach the removal position, the first sensor 65 does not turn on, and the upper cassette 17 reaching the removal position is not detected. With this example, in a state with the upper cassette 17 not mounted in the printer 11, when paper feed from the lower cassette 16 is specified, even when there is no detection of the upper cassette 17 being in the removal position, this is not an error, and at the stage when the conveyance motor 43 has been driven by a sufficient designated drive amount, paper feed from the lower cassette 16 starts and the printing operation is performed.

Meanwhile, in the case of upper cassette paper feed (affirmative judgment at S21), when the upper cassette 17 is moved to the feed position (affirmative judgment at S28), and the second sensor 66 is turned on and it is detected that the upper cassette 17 is in the feed position (affirmative judgment at S30), paper is fed from the upper cassette 17 and the printing operation is performed (S31). Also, despite the fact that the conveyance motor 43 is driven (driving in the normal rotation direction) by a designated derive amount sufficient for the upper cassette 17 to reach the feed position, the second sensor 66 does not turn on and it is not detected that the upper cassette 17 has reached the feed position (negative judgment at S29), and an upper cassette error is determined to the effect that the upper cassette 17 is not mounted in the printer 11 (S32). In this case, the printing operation does not start due to an error. The judgment processes of this subroutine (S21, S22, S24, S25, and S29) are performed by the judgment unit 93. The drive control of the conveyance motor 43 for moving the upper cassette 17 is performed by the cassette control unit 83.

Large Volume Printing Control Routine

Next, we will describe the large volume printing control routine based on FIG. 9. With this routine, when the same paper size paper P is set in both the upper cassette 17 and the lower cassette 16, when large volume printing is specified by the user on the setting screen of the host device 100, and printing is executed, printing is performed using paper P housed in both cassettes 16 and 17 while switching upper and lower cassettes 16 and 17.

When the user wishes to print using postcards or photographic paper using both the lower cassette 16 and the upper cassette 17, the same paper type and the same paper size paper is set (e.g. postcards or photographic paper). Then, the user specifies printing execution after doing an operation of the input unit 102 (keyboard, mouse and the like) of the printer 11, or an operation of the operating panel 13 of the printer 11, to perform setting of printing conditions such as the paper type, paper size, printing color, printing quality and the like, and specification of large volume printing.

When the printer driver 101 of the host device 100 receives printing execution instructions and the printing conditions are confirmed and large volume printing is specified, print job data is generated containing a header with that large volume print specification information as one print condition information, and this generated print job data is sent to the printer 11. Also, a switched flag F write area is prepared in the memory 85, and F=0 is set as the initial value. With the large volume printing of this example, the upper cassette 17 is used first as the paper feed source, and when the upper cassette 17 is empty (out of paper), the paper feed source is made to be switched from the upper cassette 17 to the lower cassette 16. When the paper feed source cassette is switched from the upper cassette 17 to the lower cassette 16 midway in the large volume printing, the switched flag F is set (F=1). When print job data is received, the computer 70 reads from the memory 85 and executes the program shown in the flow chart in FIG. 9.

Following, we will give a detailed description of the large volume printing control with the printer 11 according to FIG. 9. First, at step S41, a judgment is made of whether large volume printing is set. When large volume printing specification information is included in the header in the print job data, large volume print notification is given from the main control unit 81 to the cassette control unit 83. When the cassette control unit 83 receives large volume printing notification, the judgment unit 93 judges that large volume printing is set. If large volume printing is set (affirmative judgment at S41), a judgment is made of whether the switched flag is F=0 (S42). If the cassettes 16 and 17 have not yet been switched and F=0, paper is fed from the upper cassette 17 and the printing operation is performed on that paper P.

In other words, the cassette control unit 83 moves the upper cassette 17 to the feed position by having the conveyance motor 43 driven in the normal direction after moving the carriage 21 and switching the power transmission switching unit 76 to the cassette switching position. At the point when moving of the upper cassette 17 to the feed position has ended, the pickup roller 19 abuts the topmost paper P inside the upper cassette 17. Then, the printing control unit 82 sends topmost paper P inside the upper cassette 17 from the upper cassette 17 to the feed direction downstream side by the conveyance motor 43 being driven in the normal rotation direction after carriage 21 is moved and the power transmission switching unit 76 is switched to the feed switching position. Then, the recording head 23 prints an image or the like on the conveyed paper P.

During the paper feeding ahead of the current printing, a judgment is made of whether the upper cassette 17 is out of paper (S44). With this example, if despite the conveyance motor 43 being driven by a designated rotation amount sufficient for the edge of the paper P to reach the paper detection sensor 64, and the paper detection sensor 64 does not detect the paper P, then a judgment of out of paper is made. Of course, it is also possible to judge whether this is out of paper by providing a sensor that detects the presence of paper in each cassette 16 and 17 and judging based on the detection signal of this sensor. Then, if not out of paper, the printing operation is performed on the fed paper P (S43). Each time printing on this paper P ends, a judgment is made of whether the print job ended (S49). If the printing job has not ended, each process of steps 42 through S44 is performed again and the next paper P is fed from the upper cassette 17 and the printing operation is performed. In this way, the paper P from the upper cassette 17 is fed one sheet at a time to perform the printing operation from when the paper is out for the upper cassette 17 (affirmative judgment at S44), or until the print job ends (affirmative judgment at S49).

Then, before the print job ends, if the upper cassette 17 runs out of paper (affirmative judgment at S44), the paper feed source is switched from the lower cassette 16 to the lower cassette 16 (S45). Specifically, after the carriage 21 is moved and the power transmission switching unit 76 is switched to the cassette switching position, the cassette control unit 83 moves the upper cassette 17 from the feed position to the removal position by driving the conveyance motor 43 in the reverse rotation direction. At the point when this upper cassette 17 moving to the removal position has ended, the pickup roller 19 abuts the topmost paper P inside the lower cassette 16. When switched from the upper cassette 17 to the lower cassette 16, the switched flag F is set to F=1 (S46).

Then, after moving the carriage 21 and switching the power transmission switching unit 76 to the feed switching position, the printing control unit 82 sends the topmost paper P inside the lower cassette 16 from the lower cassette 16 to the feed direction downstream side by the rotation of the pickup roller 19 by driving the conveyance motor 43 in the normal rotation direction. Then, the recording head 23 prints an image or the like on the conveyed paper P (S47).

During paper feed ahead of the current printing, a judgment is made of whether the lower cassette 16 is out of paper (S48). With this example, when the paper detection sensor 64 does not detect the paper P despite the conveyance motor 43 being driven by a designated rotation amount sufficient for the edge of the paper P to reach the paper detection sensor 64, out of paper is judged. Of course, it is also possible to judge whether it is out of paper based on detection signals of sensors that can detect the presence of paper provided in each cassette 16 and 17. Then, if not out of paper, the printing operation is performed on the fed paper P (S47).

Each time printing on this paper P ends, a judgment is made of whether the print job has ended (S49). If the print job has not ended, the process returns to step S42, but the switched flag is F=1 (negative judgment at S42), so the process advances to step S47, and paper is fed from the lower cassette 16 and the printing operation is performed.

Then, paper feeding of the paper P from the lower cassette 16 is done one sheet at a time and the printing operation is performed until the lower cassette 16 runs out of paper (affirmative judgment at S48), or until the print job ends (affirmative judgment at S49). Then, when the print job ends, a judgment is made of whether there is a next print job (S50). When there is a next print job, the concerned routine ends for the current print job, and the concerned routine starts for the next print job.

Also, when there is no next print job (negative judgment at S50), a judgment is made of whether a third standby time T3 (5 seconds as an example) has elapsed from the point that the current print job ends (point at which the final page paper ejection operation ends) (S51). In more detail, the cassette control unit 83 sets the third standby time T3 for the cassette timer 92 at the point the print job ends and then activates the timer, and at step S51, a judgment is made of whether the time is up for the cassette timer 92, in other words, whether the third standby time T3 has elapsed. If the third standby time T3 has not elapsed, the process returns to step S50, and the next job is held until the third standby time T3 has elapsed. Then, if there is a next print job before the third standby time T3 has elapsed (affirmative judgment at S50), the concerned routine is ended for the current print job, and the concerned routine is started for the next print job. Also, when the third standby time T3 has elapsed with there still being no next print job (affirmative judgment at S51), the switched flag is set to F=0 (S52). In this way, even when the third standby time T3 is waited from the point the print job ends, when the next print job is not received, the switched flag F is reset.

Until the third standby time T3 has elapsed from the point that the last page paper ejection operation has ended for the current print job, the switched flag is not reset. Because of this, for example when multiple sheets are being printed, when printing using an application that sends one page as one job at a time (e.g. spreadsheet software), it is possible to avoid having the switched flag F reset for each job, and to try paper feed from the upper cassette 17, and if the paper has run out, it is possible to save the wasted operation of moving to the lower cassette 16. When this kind of continuous printing is divided into one job per page and sent, the time gap between print jobs is relatively short (e.g. less than 2 seconds). Because of this, with this example, the third standby time T3 is set at 5 seconds, as one example. This is because the third standby time T3 is sufficiently longer than the maximum gap time (e.g. 1 second) assumed between print jobs sent one job per page during continuous printing, and it is not very conceivable that the user will replenish the paper P in the upper cassette 17 during the time with the third standby time T3 added to the time required for printing one page. Of course, the third standby time T3 is not limited to 5 seconds, and as long as it fulfills the conditions noted above, it can be set at any suitable value within a range of between 2 to 10 seconds, for example.

If the third standby time T3 is not set, and there is no next print job at the time the print job ends, then the switched flag F will be reset each time, and at the time of the next print job, the paper feed operation will be attempted from the empty upper cassette 17, and after confirming that it is out of paper, a wasteful operation of moving to the lower cassette 16 paper feed operation is generated. However, with the large volume print control of this example, when the next print job is received by the time the third standby time T3 has elapsed, the paper feed operation from the lower cassette 16 starts, and there is no entering the wasteful operation of trying to do the paper feed operation from the upper cassette 17, so it is possible to perform multiple sheet printing quickly. In other words, it is possible to avoid the wasteful operation of again trying to do the paper feed operation from the upper cassette 17 once it has become empty during continuous printing.

Then, after the continuous printing ends, when the next print job is received with a time open of greater than the third standby time T3 from the end of the paper ejection operation of the final page of continuous printing, it is possible that the user has replenished the paper P in the upper cassette 17 by then, so the paper feed operation from the upper cassette 17 is performed. For example when the upper cassette 17 is empty with one print job, after that, despite the fact that the user replenished the paper in the upper cassette 17, it is easy to avoid the situation for example of the paper feed operation being performed with the next print job from the lower cassette for which paper has become low, and having the paper run out midway during printing.

With the first embodiment described in detail above, it is possible to obtain the following effects.

(1) A cassette timer 92 is provided, and when the first standby time T1 set at the point the print job ends (in other words, the point at which the final page paper ejection operation ends for the concerned print job) elapses, the conveyance motor 43 is driven, and the cassette preparation operation of moving the upper cassette 17 from the feed position to the removal position is performed. Because of this, after the printing ends, the user is able to remove the upper cassette 17 relatively quickly, and is able to perform replenishing of the paper P in the upper cassette 17 quickly.

(2) The judgment unit 93 judges whether a next print job for which a different feed cassette is specified from the current job has been received, and when the judgment unit 93 judged that a next print job for which a different cassette has been specified was received, the cassette control unit 83 moves the upper cassette 17 to the removal position even if it is before the first standby time T1 has elapsed. Thus, it is possible to start printing based on the next print job for which a cassette different from the current print job has been specified relatively quickly.

(3) The first standby time T1 is set to a value shorter than the second standby time T2 (T1<T2), so moving of the upper cassette 17 to the removal position is started earlier than when the standby time until the recording head 23 is capped elapses, and it is possible to eliminate or shorten the wait time until it is possible for the user to remove the upper cassette 17 and replenish the paper P2 after the print job ends.

(4) During the power on operation, the cassette preparation operation of returning the upper cassette 17 to the removal position is performed, so it is possible to improve convenience for the user who wishes to replenish the paper P in the upper cassette 17 immediately after the power is turned on.

(5) The constitution is such that when the power is off, the upper cassette 17 is returned to the removal position, so it is possible to improve convenience for a user who wishes to replenish the paper P in the upper cassette 17 when the power is off.

(6) When an error occurs, the cassette preparation operation of moving the upper cassette 17 to the removal position is performed. Thus, for example when an out of paper error or a paper size error occurs, the user is able to resolve errors quickly by pulling the upper cassette 17 to outside of the device main unit 12 and replenishing the paper P2 or replacing the paper P2 with a suitable paper size paper.

(7) Even when an error occurs, if it is a paper jam error, the cassette preparation operation is not performed. Thus, it is possible to avoid as much as possible the situation of the paper jam becoming worse due to the conveyance system being driven in common with the power source by driving the conveyance motor 43 with the cassette preparation operation.

(8) As a prohibitive condition of the cassette preparation operation of moving the upper cassette 17 to the removal position, a state was used of media other than the cassette system media being inserted in the conveyance system driven by the conveyance motor 43 which is the common power source with the upper cassette 17. Specifically, it was a case when in a printing mode other than the normal printing mode of printing cassette system media, when in for example the label printing mode or the manual feed printing mode for which a media other than the cassette system media (a tray in which a storage disk is set, or manually fed paper) exists on the conveyance path. Because of this, the conveyance motor 43 is driven to move the upper cassette 17 to the removal position, so it is possible to avoid the problem of the media inserted in the device main unit 12 from being displaced because of using another printing mode. For example, it is possible to prevent the problem of the tray in which the storage disk is set from being displaced, or the paper P inserted in the feed port 53 for performing manual feed printing from being displaced.

(9) During lower cassette paper feed, when the first sensor 65 does not turn on even when the conveyance motor 43 that is driven to move the upper cassette 17 to the removal position is driven by a designated drive amount sufficient for the upper cassette 17 to reach the removal position, the driving of the conveyance motor 43 is stopped, and the paper feed operation is performed from the lower cassette 16. Thus, when lower cassette paper feed is specified, even when in a state when the upper cassette 17 is not mounted in the printer 11, an error does not occur due to non-detection of the completion of moving of the upper cassette 17 to the removal position, and it is possible to perform the paper feed operation from the lower cassette 16.

(10) Using the upper and lower cassettes 16 and 17, if the paper of one cassette 16 runs out, printing continues by switching to the other cassette 17, so it is possible to perform large volume printing exceeding the number of sheets housed in one cassette.

(11) It is possible to switch a plurality of cassettes 16 and 17 and to do large volume printing using paper housed in both cassettes 16 and 17, so even when trying to make the printer thinner by making the cassettes 16 and 17 thinner, compared to when printing using only one cassette, it is possible to get by with fewer times replenishing paper in the cassettes midway in printing, and it is possible to perform large volume printing in a shorter time.

(12) When performing large volume printing (many recording sheets) using the paper within both cassettes 16 and 17 by switching the upper cassette 17 and the lower cassette 16, for example it is necessary to house the same paper size (relatively small paper size that can be housed in the upper cassette 17) paper P as the upper cassette 17 in the lower cassette 16. For example, even if one forgets to house that same paper size paper in the lower cassette 16, by feeding from the upper cassette 17 first, printing is performed at the start on the paper P2 of the upper cassette 17, and it is possible to avoid the situation of printing suddenly becoming impossible right from the start. For example, when the lower cassette 16 is subject to the feed operation first, when the same paper size paper as the upper cassette 17 side is not housed in the lower cassette 16, recording becomes impossible from the start due to a paper size error, but this kind of situation can be avoided.

(13) After switching from the upper cassette 17 to the lower cassette 16, the switched flag F is set (F=1), and when F=1, the paper feed operation from the lower cassette 16 is performed. Thus, when doing printing of a plurality of sheets per job, after switching from the upper cassette 17 to the lower cassette 16, without trying to do the paper feed operation from the upper cassette 17, it is possible to perform the paper feed operation from the lower cassette 16 right away. For example, it is possible to save on the wasteful operation of shifting to the paper feed operation from the upper cassette 17 after trying to do the paper feed operation from the upper cassette 17 despite the upper cassette 17 being empty.

(14) When out of paper is detected for the upper cassette 17 before switching cassettes (switched flag F=0), automatic switching to the lower cassette 16 is implemented, and after this cassette is switched (switched flag F=1), when out of paper is detected for the lower cassette 16, this is an out of paper error for the lower cassette 16. Thus, when the upper cassette 17 for which the paper feed operation was being performed is out of paper, it is possible to switch automatically from the upper cassette 17 to the lower cassette 16, and when the lower cassette 16 runs out of paper after this switch, it is possible to notify the user of an out of paper error.

The embodiments noted above can also be modified to the modes below.

The timing start time of the first standby time T1 is not limited to being the point at which the paper ejection operation ends, and it can also be the point when the printing ends (in other words, the point at which the paper ejection operation starts). The time at which it is possible to receive the next print job after the prior print job ends included in a series of printing when there is a series of printing divided into print jobs of one page each is the wait time allowed until it becomes possible for the user performing replenishment of paper in the upper cassette 17 after printing ends when the upper cassette 17 reaches the removal position and can be pulled out. The first standby time T1 can be a time other than 2 seconds, for example, and as an example can be a value within the range of 1 second to 5 seconds.

Furthermore, the first standby time T1 is not limited to being a time for which a margin is added to the maximum time gap (assumed receiving gap) assumed for the printer 11 side receiving a plurality of print jobs divided for each page in a printing series (multiple page printing) based on one printing instruction. Even if it is a next print job with different printing instructions, if it is a print job received within a fixed time from the point the previous print job ended, that fixed time for waiting for receiving of that next print job can also be set as the first standby time T1. However, in this case as well, the first standby time T1 is preferably shorter than the second standby time T2 (T1<T2).

The timing method of the first standby time T1 is not limited to the method of counting down the count value set in the counter. For example, it is also possible to count up the counter until the first standby time T1 is reached.

The first standby time T1 can also be set to be a longer time than the second standby time T2 which is the wait time until the recording head 23 is capped after the print job ends.

Of the errors that occur with the printer 11, it is possible to perform the cassette preparation operation only when types of errors occur that require access by the user of the upper cassette 17 such as an out of paper error, paper size error or the like. Also, it is not necessary to move the upper cassette 17 to the removal position for all of the three times of the power on operation received time, the power off operation received time, and the power saving mode shift time, and it is possible to set as the time for performing the cassette preparation operation only one or two times among the power supply on operation received time, the power off operation received time, and the power saving mode shift time.

Setting the large volume printing can be performed by operating panel 13 of the printer 11, or it is possible to specify it by operating the input unit 102 using the printing condition setting screen displayed on the screen by the printer driver 101 with the host device 100. Examples of the host device 100 include a portable terminal (smart phone or the like) in addition to a personal computer.

For the cassette preparation operation start condition, it is possible to apply at least one of the elapsed time of the first standby time T1 from the time when the print job ends, the power on operation, power off operation, or error occurrence time, or time when shifted to power saving mode. For example, it is also possible to perform the cassette preparation operation only at the point the first standby time T1 has elapsed from the point the print job ended.

The large volume printing can be constituted so that when the paper feed operation from the lower cassette 16 is performed first, when the lower cassette 16 becomes empty, there is a switch from the lower cassette 16 to the upper cassette 17. It is also possible for the user to specify a cassette for which to perform the feed operation first among the plurality of cassettes.

The number of feed cassettes is not limited to being two (two levels). It is also possible to constitute this equipped with three or more independent detachable feed cassettes in relation to the device main unit 12. In this case, an electric powered cassette moved by the power of an electric motor can be one or two of those. When there are two or more electric powered cassettes which share a feed roller, it is acceptable to move the electric powered cassette in the feed position at that time to the removal position. The short feed cassette is preferably mounted on the top part of the other feed cassette.

It is also possible to arrange the cassette 17 for which the length in the media sending direction is the relatively short side on the bottom, and the cassette for which the media sending direction length is the relatively long side on the upper side. Also, when there are three layers or more of cassettes, it is possible to arrange one or a plurality of electric powered cassettes for which the length in the media sending direction is shorter than the maximum length cassettes at the level between the highest level and the lowest level cassettes.

The capping unit was constituted using the maintenance device 77, but it is also possible to have a capping device equipped only with the cap 78 that caps the recording head 23.

The power source constituting the drive unit is not limited to being a rotation type motor, but can also be a linear motor. Also, the power source can be an electric power cylinder, a pneumatic cylinder, a hydraulic cylinder or the like.

The media is not limited to being paper, and can also be a film made of resin, a metal foil, a metal film, a resin and metal composite film (laminate film), a woven material, a non-woven fabric, a ceramic sheet or the like.

The recording device is not limited to being an ink jet type, and can also be a dot impact type, or a laser type. Furthermore, the recording device is not limited to being a serial printer, and can also be a line printer or a page printer.

The recording device is acceptable as long as it has at least a recording function (printing function) for forming images on media, and for example can be a composite device equipped with a printing function, a scanner function, and a copy function.

With each of the embodiments noted above, the recording device was put into specific form as an ink jet printer which is one liquid spraying device, but when applying to a liquid spraying device, this is not limited to a printer, and can also be put into specific form for a liquid spraying device that sprays or discharges a liquid other than ink (including a liquid made by dispersing or mixing functional material particles in a liquid, a fluid body such as a gel or the like). For example, it can also be a recording device that sprays a liquid including in the form of material dispersed or dissolved such as an electrode material or colorant (pixel material) or the like used for manufacturing liquid crystal displays, EL (electroluminescence) displays, and surface light emitting displays, on a sheet form substrate as an example of a media. Then, if a plurality of levels of feed cassettes on which sheet form substrates are set are provided to be independently detachable, it is possible to avoid the problem of the upper cassette not being in the removal position during replenishment of the sheet form substrate to the feed cassette. In this way, the media (recording media) can also be a substrate for which components or wiring or the like are formed using an ink jet. Included in the "liquid" sprayed by the liquid spray device are liquids (including inorganic solvents, organic solvents, solutions, liquid resin, liquid metal (metallic melt), and the like), liquid bodies, fluid bodies and the like.

What is claimed is:

1. A recording device comprising:

a device main unit, a first media housing unit capable of housing media, a second media housing unit capable of housing media, a feed unit provided in common for the first media housing unit and the second media housing unit, for feeding the media from one of that first and second media housing unit, a drive unit that moves the first media housing unit between a feed position at which feeding by the feed unit is possible, and a removal position at which removal of the first media housing unit from the device main unit is possible, a conveyance unit for conveying media fed by the feed unit, a recording unit for performing recording on conveyed media based on a recording job, a judgment unit for judging whether or not a designated standby time has elapsed still without a next recording job after the current recording job performed by the recording unit has ended in a state with the first media housing unit arranged in the feed position, and a control unit for controlling the drive unit to hold the first media housing unit in the feed position when the judgment unit judges that it is before the standby time has elapsed, and on the other hand, to move the first media housing unit from the feed position to the removal position when the judgment unit judges that it is after the standby time has elapsed, wherein the judgment unit also judges whether or not a next recording job for which a different media housing unit is specified than the current recording job has been received, and the control unit moves the first media housing unit to the removal position when the judgment unit judges that a next recording job for which the different media housing unit is specified has been received, even when it is before the standby time has elapsed.

2. The recording device according to claim 1, further comprising a capping unit for capping the recording unit, wherein the control unit controls the drive unit to move the first media housing unit from the feed position to the removal position before capping is done using the capping unit.

3. The recording device according to claim 2, further comprising a media presence detection unit for detecting the presence of at least media of the first media housing unit, wherein when the media housing unit subject to the feed operation is the first media housing unit, when an out of media state is detected for that first media housing unit, the control unit moves that first media housing unit from the feed position to the removal position, and switches the media housing unit subject to the feed operation by the feed unit to the second media housing unit.

4. The recording unit according to claim 3, wherein the control unit moves the first media housing unit to the removal position at least at one time among when a power on operation is received, when a power off operation is received, and when shifted to the power saving mode.

5. The recording device according to claim 4, wherein the drive unit and the conveyance unit are equipped with a common power source.

6. The recording device according to claim 1, further comprising an error detection unit for detecting out of media errors, media size errors, and media jam errors, wherein the control unit moves the first media housing unit from the feed position to the removal position when at least one of the out of media error or the media size error is detected, and meanwhile, holds the first media housing unit at the feed position when the media jam error is detected.

7. The recording device according to claim 6, further comprising a detection unit for detecting that the first media housing unit is arranged at the removal position, wherein the feed unit is constituted so that in a state with the first media housing unit in the feed position, that first media housing unit is the subject of the feed operation, and in a state with the first media housing unit in the removal position, the second media housing unit is the subject of the feed operation, and when the second media housing unit is the subject of the feed operation, the control unit has the drive unit drive the first media housing unit in the direction facing the removal position, and when it is detected that the first media housing unit is arranged at the removal position, feeding of media from the second media housing unit starts.

8. The recording device according to claim 6, further comprising a detection unit for detecting that the first media housing unit is arranged at the removal position, wherein the control unit controls the drive unit, and when moving from the feed position to the removal position, when arrangement of the first media housing unit at the removal position is not detected even when sufficient drive is implemented to have the first media housing unit reach the removal position, feeding of media from the second media housing unit starts.

* * * * *